US006049685A

United States Patent [19]

Murakami et al.

[11] Patent Number: 6,049,685

[45] Date of Patent: Apr. 11, 2000

[54] TONER SUPPLY CONTAINER DETACHABLY MOUNTABLE TO A MAIN ASSEMBLY OF AN IMAGE FORMING APPARATUS

[75] Inventors: Ayumu Murakami, Shizuoka-ken; Kyota Miyazaki, Kawasaki; Katsuya Murakami, Numazu; Fumio Tazawa, Shizuoka-ken, all of Japan

[73] Assignee: Canon Kabushiki Kaisha, Tokyo, Japan

[21] Appl. No.: 09/099,038

[22] Filed: Jun. 18, 1998

[30] Foreign Application Priority Data

Jul. 31, 1997 [JP] Japan ..... 9-206927
Jun. 16, 1998 [JP] Japan ..... 10-168371

[51] Int. Cl.[7] ..... G03G 15/08; G03G 15/00

[52] U.S. Cl. ..... 399/263

[58] Field of Search ..... 399/262, 263, 399/258, 254, 255

[56] References Cited

U.S. PATENT DOCUMENTS

| | | | |
|---|---|---|---|
| 4,212,264 | 7/1980 | Knechtel et al. | 118/653 |
| 4,611,730 | 9/1986 | Ikesue et al. | 222/167 |
| 4,878,603 | 11/1989 | Ikesue et al. | 222/167 |
| 5,202,732 | 4/1993 | Yahata | 399/263 |
| 5,298,952 | 3/1994 | Kamijo et al. | 399/123 |
| 5,307,129 | 4/1994 | Miura et al. | 355/260 |
| 5,500,719 | 3/1996 | Ichikawa et al. | 355/260 |
| 5,629,759 | 5/1997 | Jyoroku | 399/262 |

FOREIGN PATENT DOCUMENTS

| | | |
|---|---|---|
| 61-116372 | 6/1986 | Japan . |
| 7-44000 | 2/1995 | Japan . |
| 7-113796 | 6/1995 | Japan . |

*Primary Examiner*—Joan Pendegrass
*Attorney, Agent, or Firm*—Fitzpatrick, Cella, Harper & Scinto

[57] ABSTRACT

A toner supply container detachably mountable to a main assembly of an electrophotographic image forming apparatus includes (a) a toner accommodating portion for accommodating toner; (b) a toner supply opening for discharging toner accommodated in the toner accommodating portion; (c) a toner feeding portion for feeding the toner accommodated in the toner accommodating portion toward the toner supply port; (d) a first driving force receiving portion for receiving driving force for driving the toner feeding portion from the main assembly of the apparatus; (e) a toner stirring portion for stirring the toner accommodated in the toner accommodating portion; (f) a second driving force receiving portion for receiving driving force for driving the toner stirring portion from the main assembly of the apparatus; wherein the first driving force receiving portion and the second driving force receiving portion is disposed outside the toner accommodating portion and at a free end portion in a direction of mounting the toner supply container to the main assembly of the apparatus.

18 Claims, 28 Drawing Sheets

(D)

(A)

(B)

(C)

TONER SUPPLY CONTAINER DETACHABLY MOUNTABLE TO A MAIN ASSEMBLY OF AN IMAGE FORMING APPARATUS

FIELD OF THE INVENTION AND RELATED ART

The present invention relates to a toner-supply-container detachably mountable to a main assembly of an electrophotographic image forming apparatus and an electrophotographic image forming apparatus to which the toner supply container is detachably mountable.

The electrophotographic image forming apparatus forms an image on a recording material using an electrophotographic image formation type process. Examples of an electrophotographic image forming apparatus include an electrophotographic copying machine, an electrophotographic printer (laser beam printer, LED printer or the like), a facsimile machine and a word processor.

Heretofore, an electrophotographic image forming apparatus, such as an electrophotographic copying machine or a printer, uses fine toner powder as a developer. When the developer in the main assembly of the apparatus is used up, the toner is supplied into the main assembly of the apparatus using a toner supply container.

Here, in a known system, since the toner is a very fine powder or particles, the toner supply container is kept set within the main assembly of the apparatus, and the toner is discharged at a small rate through a small opening during the toner supply operation, so as to prevent toner scattering. In such a system, it is difficult to let the toner fall by gravity or the like, and therefore, some feeding means is required.

An example of a toner supply container provided with such a toner feeding means is disclosed in Japanese Patent Application Publication No. HEI-7-113796. The toner supply container is generally cylindrical, and one end portion thereof is provided with a relatively small opening for discharging the toner. In the container, there is provided a helical toner feeding member which receives a driving force from the outside, penetrating through a wall of the end of the container.

A bearing seal mechanism is necessary to prevent toner leakage through the through-hole at the end for the drive transmission. Generally, the seal mechanism includes a gear member provided at the end of the feeding member, and a seal is sandwiched between the gear member and the container wall surface. The seal is in many cases an annular wool felt, oil seal or the like.

The toner supply container is used while being kept in the main assembly of the apparatus, and the toner is fed by rotation of the toner feeding member driven from the main assembly, and the toner is discharged at a small rate through the opening.

On the other hand, another tone supply container having toner feeding means is disclosed in Japanese Laid-open Patent Application No. HEI-7-44000. The toner supply container is in the form of a cylindrical bottle, and the inside surface thereof is provided with a helical rib, and a small toner discharging outlet is provided adjacent the center at one end.

The toner supply container, as contrasted to the above-described conventional example, does not have any inner feeding means, and is used while being kept in the main assembly of the apparatus, and the main body of the container itself is rotated by the main assembly to feed the toner. The toner fed to the end adjacent the discharging outlet is guided by an extended portion adjacent the opening to be raised toward the discharging outlet adjacent the center of the container, and then is discharged.

Heretofore, an electrophotographic image forming apparatus, such as an electrophotographic copying machine or a printer, uses fine toner powder as a developer. When the developer of the main assembly of the image forming apparatus is consumed, the toner is supplied into the image forming apparatus using a toner supply container.

Here, in a known system, since the toner is a very fine powder or particles, the toner supply container is kept set within the main assembly of the apparatus, and the toner is discharged at a small rate through a small opening during the toner supply operation, so as to prevent toner scattering.

SUMMARY OF THE INVENTION

Accordingly, it is a principal object of the present invention to provide a toner supply container which is kept in the main assembly of an electrophotographic image forming apparatus and which can supply the toner into the main assembly of the apparatus with high reliability.

It is another object of the present invention to provide a toner supply container of a low-manufacturing-cost type.

It is a further object of the present invention to provide a toner supply container capable of stirring and feeding the toner with certainty.

According to an aspect of the present invention, there is provided a toner supply container detachably mountable to a main assembly of an electrophotographic image forming apparatus, comprising: (a) a toner accommodating portion for accommodating toner; (b) a toner supply opening for discharging toner accommodated in the toner accommodating portion; (c) a toner feeding portion for feeding the toner accommodated in the toner accommodating portion toward the toner supply port; (d) a first driving force receiving portion for receiving a driving force for driving the toner feeding portion from the main assembly of the apparatus; (e) a toner stirring portion for stirring the toner accommodated in the toner accommodating portion; (f) a second driving force receiving portion for receiving a driving force for driving the toner stirring portion from the main assembly of the apparatus; wherein the first driving force receiving portion and the second driving force receiving portion are disposed outside the toner accommodating portion and at a fee end portion in a direction of mounting the toner supply container to the main assembly of the apparatus.

It is a further object of the present invention to provide an electrophotographic image forming apparatus to which such a toner supply container is detachably mountable.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the embodiments of the present invention will be described with reference to the drawings.

Figure 1:
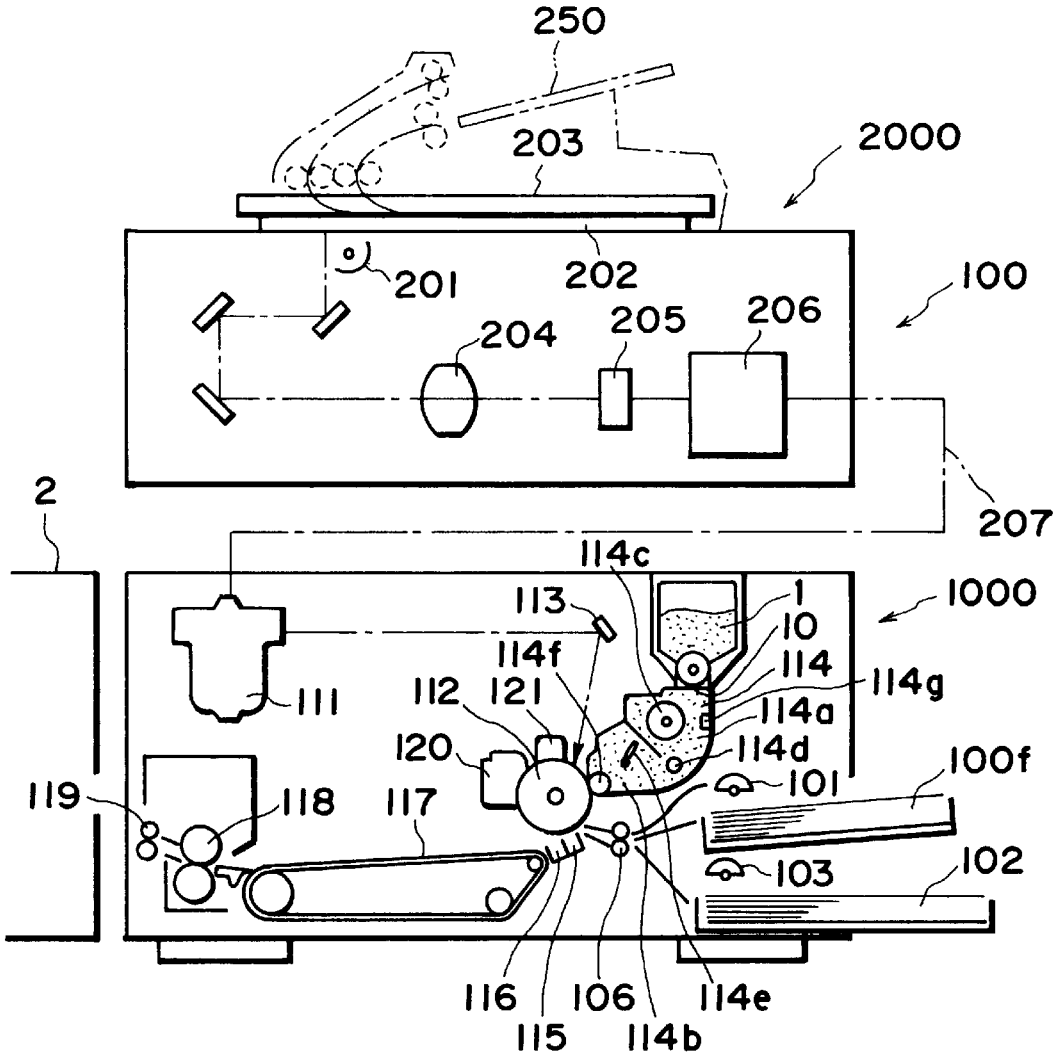
FIG. 1 is a schematic sectional view of an electrophotographic copying machine which is an example of an electrophotographic image forming apparatus to which a toner supply container according to a first embodiment is mountable.

FIG. 1 is a schematic section of an electrophotographic copying machine, that is, an example of an electrophotographic image forming apparatus in which a toner supplying container, in accordance with the first embodiment of the present invention, is installable. In the drawing, reference numeral 100 designates the main assembly of an electrophotographic copying machine equipped with a printer 1000 and a scanner 2000, which will be simply referred to as the "main assembly".

The alphanumeric character 100f designates a top cassette mounted in the printer 1000. The recording media (hereinafter, "sheets") in this top cassette 100f are separated, one by one, and guided to the register roller 106, by the function of a separator claw (unillustrated) and a feeder roller 101. The cassette designated by a reference numeral 102 is a bottom cassette. The sheets in the bottom cassette 102 are separated one by one, and sent to the register roller 106, by the function of a separator claw (unillustrated) and a feeder roller 103. As for the recording medium, an ordinary sheet of paper, an OHP sheet, and the like may be optionally used.

The reference numeral 111 designates a laser-based writing device; 112 denotes an electrophotographic photosensitive drum; 113 denotes an optical system for writing image data; 114 denotes an image developing section; 115 denotes a transfer charger; and a reference numeral 116 designates a separator charger. These components constitute an image forming section. The reference numeral 117 designates a conveyer belt for conveying the sheets on which an image has been formed; 118 denotes a fixing apparatus; and the reference numeral 119 designates a discharger roller. The sheet on which an image has been formed is discharged into a sorter 2 by the discharger roller 119. The container designated by a reference numeral 1 is a toner supply container, which will be described later.

Also in the same drawing, a reference numeral 201 designates a light source of the scanner 2000; 202 denotes a platen glass; 203 denotes a hinged or flexible plate for pressing down an original; 204 denotes a lens; 205 denotes a receptor element (photo-electric transducer); and the reference numeral 206 designates an image processing section. The image data of an original, which are read by the scanner 2000, are processed by the image processing section 206, being converted into electric signals 207, and then, are transmitted to a laser-based writing device 111. Then, an optical image in accordance with the image data is formed on the peripheral surface of the photosensitive drum 12 through an image writing system 113.

The transfer charger 115 is a charger for transferring a toner image formed on the photosensitive drum 112 onto a sheet. The separator charger 116 is a charger for separating a sheet, onto which a toner image has been transferred, from the photosensitive drum 112. The fixing apparatus 118 is an apparatus for permanently fixing the toner image on a sheet to the sheet, with the use of heat and pressure.

In the main assembly 100 structured as described above, the image developing section 114, a cleaner section 120, and a primary charger 121 are disposed in a manner to surround the photosensitive drum 112. The image developing section 114 is a section for developing, with the use of toner, an electrostatic latent image formed on the photosensitive drum 112 according to the image data. The toner supply container 1 for supplying the developing section 114 with toner is removably installed in the main assembly 100 by a user of the image forming apparatus.

The image developing section 114 comprises a toner hopper 114*a* and an image developing device 114*b*. The toner hopper 114*a* has a stirring member 114*c* for stirring the toner supplied from the toner supply container 1. The toner stirred by this stirring member 114*c* is delivered to the image developing device 114*b* by a magnetic roller 114*d*. The developing device 114*b* comprises an image developing roller 114*f* and a toner delivering member 114*e*. The toner delivered from the toner hopper 114*a* by the magnetic roller 114*d* is delivered to the image developing roller 114*f* by the toner delivering member 114*e*, and then, is supplied to the photosensitive drum 112 by the image developing roller 114*f*.

The cleaning section 120 is a section for removing the toner particles remaining on the photosensitive drum 112. The primary charger 121 is a charger for charging the photosensitive drum 112.

The printer 1000 and the scanner 2000 may be separate from each other as shown in the drawing, or integral. When they are integral, the combination of the two is called an "image forming apparatus". If the signals from the image-data-processing section are inputted into the laser-based image writing device 111 of the printer 1000, which projects a laser beam modulated with the inputted signals, the printer 1000 acts as the outputting device for a copying machine, and if facsimile signals are inputted into the writing device 111, the printer 1000 acts as the outputting device for a facsimile machine.

Further, if the output signals from a personal computer are inputted into the writing device 111 of the printer 1000, the printer 1000 acts as the so-called printer. On the other hand, the signals from the image data processing section 206 of the scanner 2000 may be transmitted as facsimile signals to a facsimile machine. Further, the pressing plate 203 may be replaced with an automatic original feeding apparatus 250 outlined with the double-dot chain line, so that a plurality of originals are automatically read.

Figure 11:
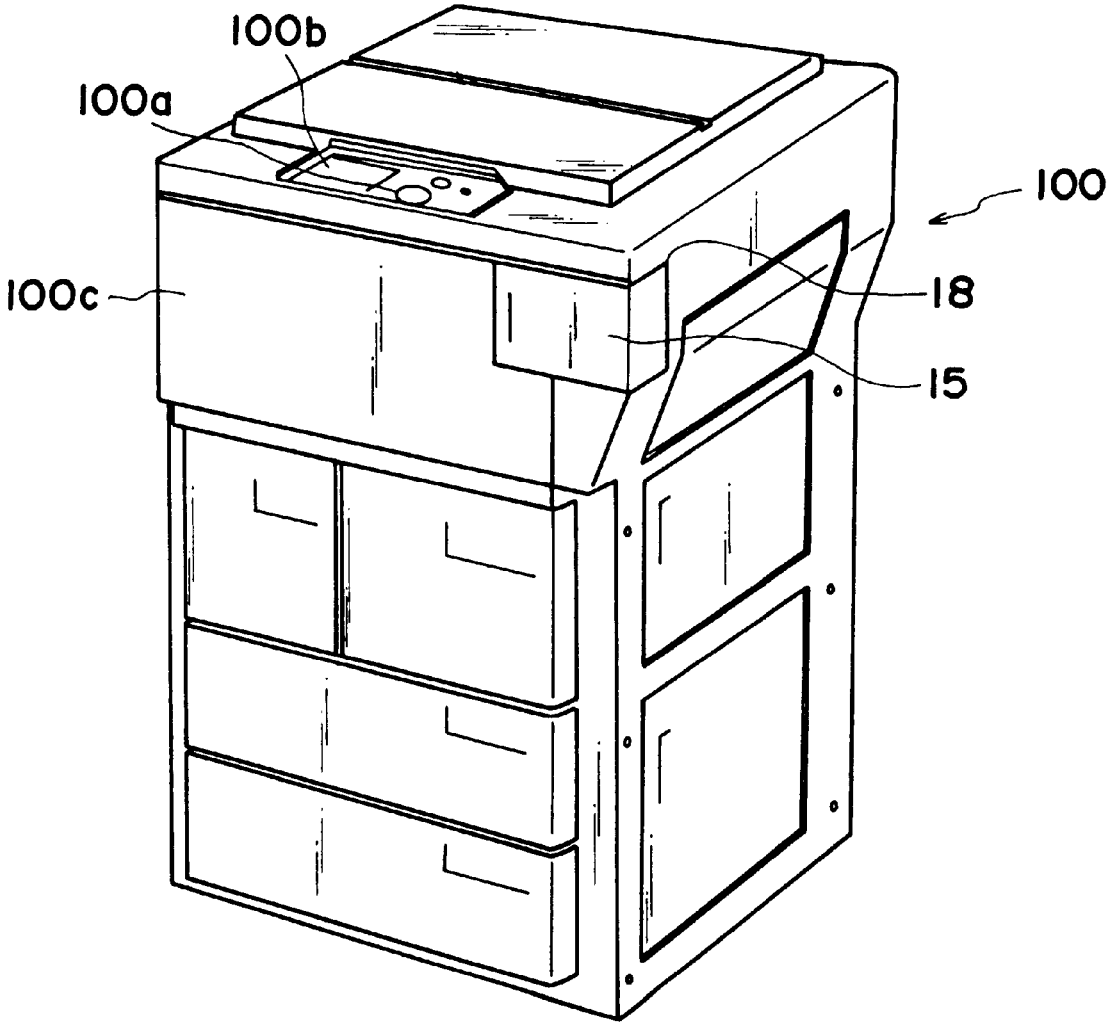
FIG. 11 is a perspective view of an electrophotographic image copying machine.
Figure 12:
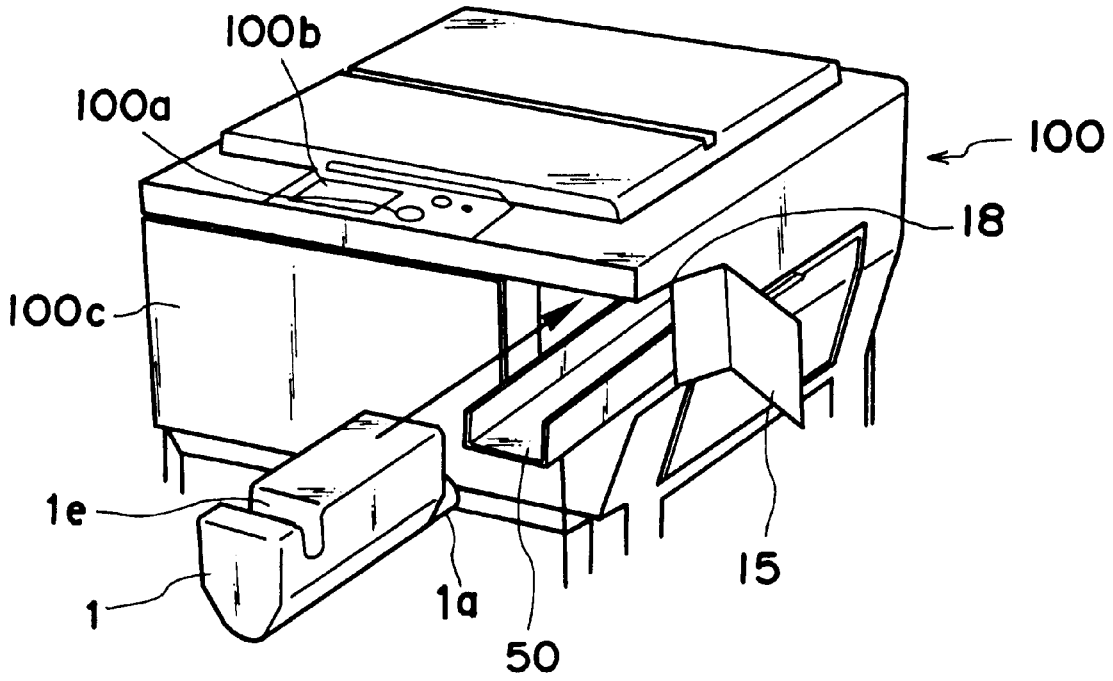
FIG. 12 illustrates the toner supply container which is being mounted to the electrophotographic copying machine while the cover for toner supply container exchange is open.

A cover 15 for replacing the toner supply container, which constitutes a part of the external wall illustrated in FIG. 11, is opened by a user as illustrated in FIG. 12, and a container mount 50 is pulled out to a predetermined location by a driving system (unillustrated). The toner supply container 1 is placed on this container mount 50. In order for a user to remove the toner supply container 1 from the main assembly 100, the user opens the cover 15 to pull out the container mount 50, and removes the container 1 from the container 50. The cover 15 is dedicated for installing or removing the toner supply container 1; it is opened or closed only for installing or removing the container 1. For the maintenance of the main assembly 100, a front cover 100*c* is provided.

It should be noted here that the container mount 50 may be eliminated; the toner supply container 1 may be directly mounted into, or removed from, the main assembly.

Figure 2:
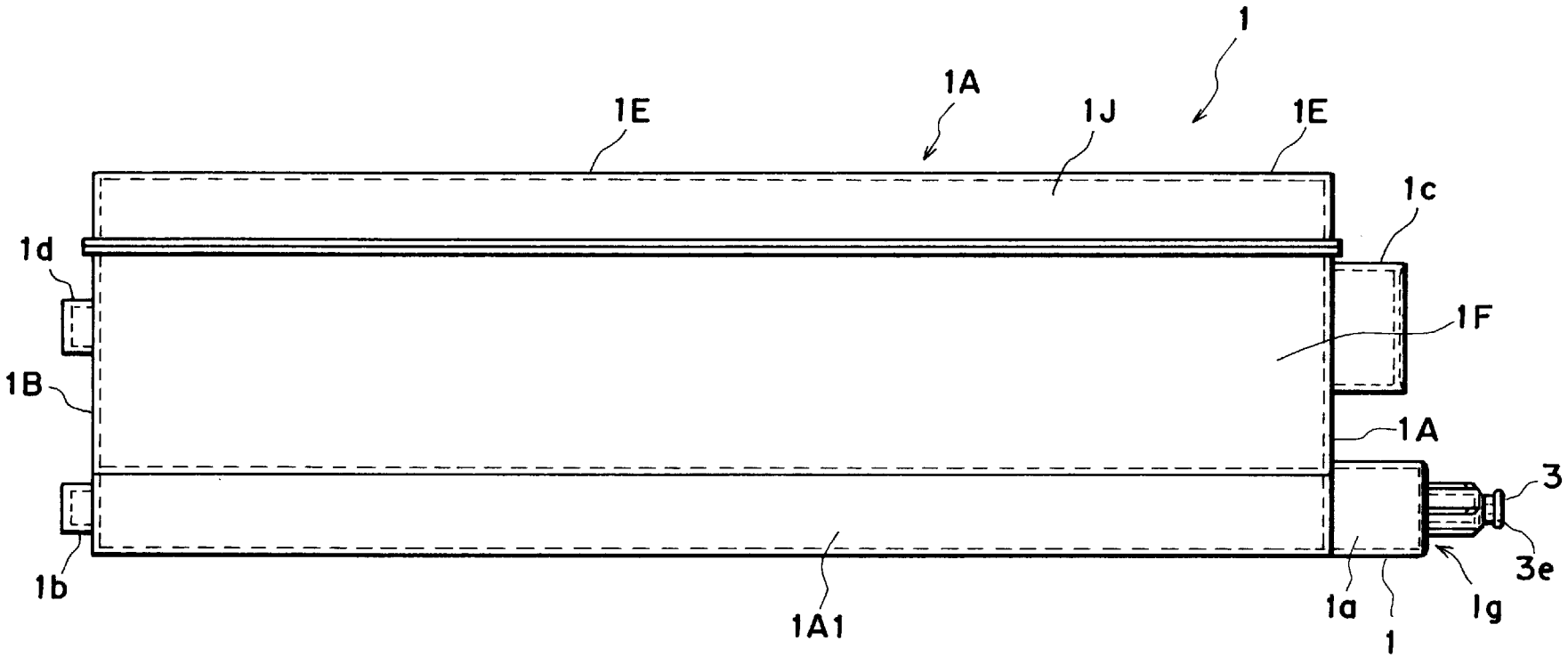
FIG. 2 is a side view of the toner supply container.
Figure 3:
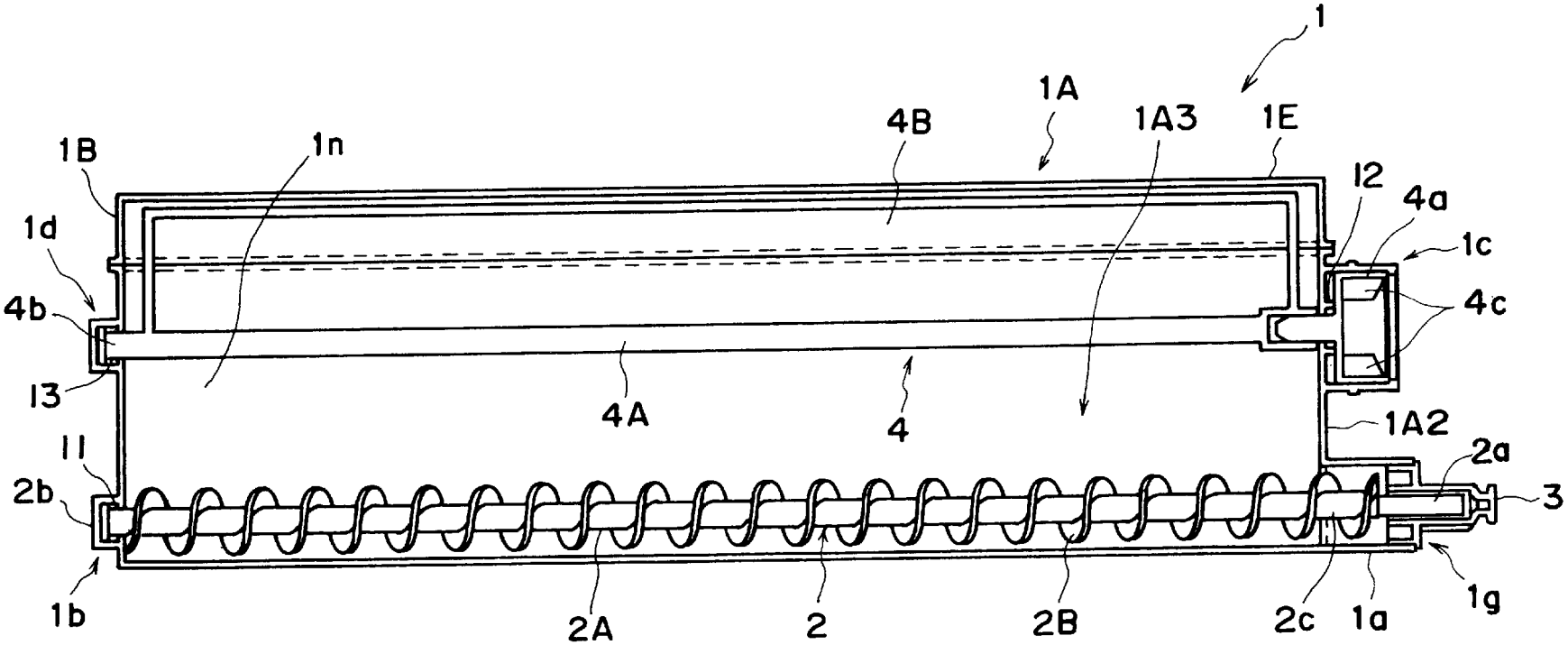
FIG. 3 is a sectional side view of the toner supply container.
Figure 4:
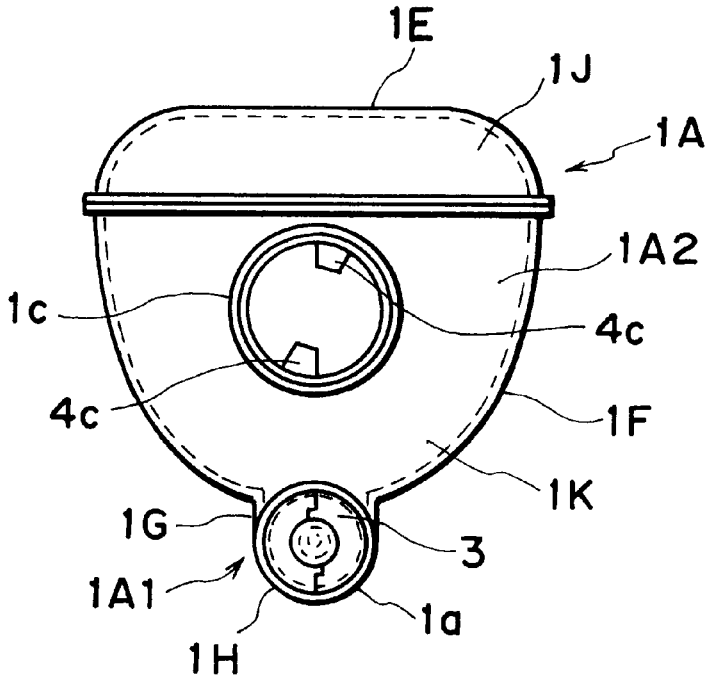
FIG. 4 is a front view of the toner supply container.
Figure 5:
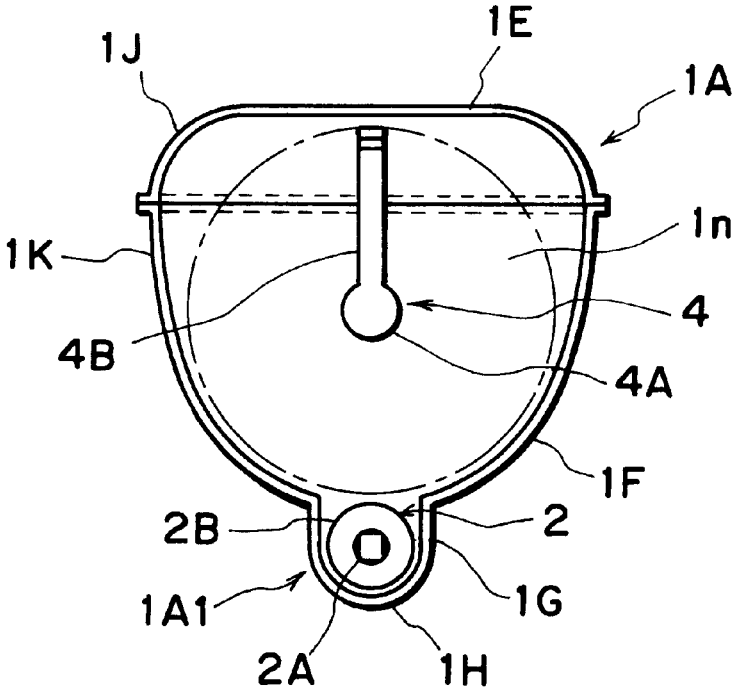
FIG. 5 is the sectional front view of the toner supply container.

Next, the toner supply container 1 in this embodiment will be described with reference to FIGS. 2–5. FIG. 2 is a side view of the toner supply container 1; FIG. 3 is a section of the toner supply container 1, parallel to the lateral walls of the toner supply container 1; FIG. 4 is a front view of the toner supply container 1; and FIG. 5 is a section of toner supply container 1, parallel to the front wall of the toner supply container 1. The toner is a substance for developing the electrostatic latent image formed on the peripheral surface of the photosensitive drum 112. There are single component toners, two component toners, and the like, which are selectively used.

In the drawings, a reference character 1A designates the main body of the toner supply container 1 (hereinafter, "main body"); 2 denotes a toner conveying member; 3 denotes a sealing member; and a reference numeral 4 designates a stirring member.

A reference numeral 10 designates the toner receiving opening of the toner hopper 114*a* of the main assembly 100. The toner released from the toner supply container 1 is guided into the toner hopper 114*a* through this toner receiving opening 10. However, an arrangement may be made so that the toner released from the toner supply container 1 is guided straight, that is, without going through the toner hopper 114*a*, to the image developing device 201*b*.

The main body 1A of the toner supply container 1 comprises a curved wall section 1F, a straight wall section 1G, and a semicircular wall section 1H. The curved wall section narrows toward the bottom. The straight wall section is directly below the curved wall section, and its width is the same from the top to the bottom. The semicircular wall section 1H is directly below the straight wall section. In this specification, the term "bottom portions" refers to the portions which come to the bottom side as the toner supply container 1 is installed into the main assembly 100. The term "bottom surfaces and top surfaces" refers to the surfaces which come to the bottom side and the top side, respectively, as the toner supply container 1 is installed into the main assembly 100. The term "lateral surfaces" refers to the surfaces which are upright when the toner supply container 1 is in the main assembly 100. The positioning of the toner supply container 1 in the main assembly 100 is the same throughout FIGS. 2, 3, 4, 5, 7, 10, 14, 15, 18, 19 and 32.

First, the container main body 1A will be described. The main body 1A is provided with a toner releasing portion 1*a*, which projects from the bottom portion of the lateral wall 1A2, that is, the lateral wall located at one of the longitudinal ends of the main body 1A, and through which the toner stored in the toner storing portion 1A3 is released into the main assembly 100. This toner releasing portion 1*a* is provided with a toner releasing opening 1*g* through which the toner is released.

Also, the container main body 1A is provided with a bearing portion 1*b*, which projects outward from the bottom portion of the lateral wall 1B, that is, the lateral wall located on the other longitudinal end of the main body 1A, and rotatively bears the toner conveying member 2. In other words, the bearing portion 1*b* is located opposite to the toner releasing portion 1*a*. Further, the container main body 1A is provided with the bearing portions 1*c* and 1*d*, which are located above the toner releasing portion 1*a* and the bearing portion 1*b*, respectively, and rotatively bear the stirring member 4.

The container main body 1A is desired to be formed of plastic material by injection molding. However, the material and the production method for the container main body 1A may be different from the plastic material and the injection molding, respectively.

The container main body 1A may be constituted of two or more pieces, depending on the manufacturing situation, which are integrated by welding, gluing, or the like method. In manufacturing the container main body 1A in this embodiment, the top frame and the bottom frame are separately formed of high impact polystyrene by injection molding, and are welded together by vibration welding.

Next, the toner conveying member 2 will be described. The toner conveying member 2 is a member for moving the toner stored in the toner storing portion 1A3 toward the toner releasing opening 1*g*. It is constituted of a shaft portion 2A, and a spiral blade 2B, that is, an actual toner conveying portion, which is fitted around the shaft portion 2A, and moves the toner in the predetermined direction as the shaft portion 2A is rotated. The toner conveying member 2 is attached to the container main body 1A in such a manner that the axial line of the shaft portion 2A approximately aligns with the center of the toner releasing opening 1*g*, which is substantially circular.

The configuration of the toner conveying member 2 does not need to be limited to the above described type, that is, the so-called screw type. For example, it may be constituted of a shaft portion 2A, and a flexible blade attached to the shaft portion 2A. The shaft portion 2A and the blade portion 2B may be integrally formed, or separately formed. The shaft portion 2A and the blade portion 2B in this embodiment are integrally formed of plastic material.

The toner conveying member 2 also comprises a portion 2C, which extends through the cylindrical portion of the toner releasing portion 1*a*. In this embodiment, this extending portion 2C projects outward beyond the toner releasing portion 1*a*, and the force for rotatively driving the toner conveying member 2 is transmitted from the main assembly 100 to the toner conveying member 2 through this portion 2*c* extending outward from the toner releasing portion 1*a*. Further, in this embodiment, this extending portion 2C is fitted with the sealing member 3, which is rendered movable in the axial direction of the shaft portion 2A.

In this embodiment, the sealing member 3 is given four functions: (1) sealing the toner releasing portion 1*a*; (2) receiving the rotative driving force transmitted from the main assembly 100; (3) transmitting the rotative driving force to the toner conveying member 2; and (4) engaging with a coupling member 6 provided on the main assembly side to open or close the toner releasing portion 1*a*. In other words, the driving force which the sealing member 3 receives from the main assembly 100 is transmitted to the shaft portion 2A through the extending portion 2C to rotate the toner conveying member 2. These functions will be described later in detail.

The outward end portion 2*a* of the extending portion 2C is shaped for receiving the rotative driving force from the main assembly 100, through the sealing member 3. More specifically, in this embodiment, this outward end portion 2*a* is cut in the form of a letter "H", so that the shaft portion 2A is supported by the sealing member 3, by the portion 2*a* of the extending portion 2C, which is extending outward from the toner releasing portion 1*a*. The other end of the shaft portion 2A is rotatively supported by the bearing portion 1*b* of the container main body 1A. Thus, the toner conveying member 2 is freely rotatable as long as the toner supply container 1 remains unsealed.

The toner conveying member 2 is supported by the sealing member 3 so that the toner conveying blade 2B does not make contact with the internal surface 1*a*1 of the toner releasing portion 1*a*, and also the shaft portion 2A is rendered substantially parallel to the internal surface 1*a*1 of the toner releasing portion 1*a*. With the toner conveying member 2 being supported as described above, the toner is conveyed toward the toner releasing opening 1*g*, substantially horizontally, as the toner conveying member 2 is rotated, and also, it is possible to prevent the microscopic toner particles from being forced into the gap between the blade 2B and the internal wall 1*a*1 of the toner releasing portion 1*a*, rubbed against the wall 1*a*1, melted, and solidly adhered to the wall 1*a*1; the microscopic toner particles are prevented from being aggregated into substantially larger toner particles.

It is desirable that the toner conveying member 2 is also integrally formed of plastic material by injection molding or the like method, since such material and a manufacturing method are simple. However, material and manufacturing methods other than those described above may be used. For example, the toner conveying member 2 may be constituted of an optional number of pieces, which are separately formed and then joined together. The bearing portion 1*b* is provided with a sealing member 11, which prevents the toner from entering the bearing portion 1*b*.

Next, the sealing member 3 will be described with reference to FIG. 6. FIG. 6(A) is a plan view of the sealing member, as seen from the front side of the printer; FIG. 6(B) is a plan view of the sealing member as seen from the direction of an arrow mark A in (A); FIG. 6(C) is a plan view of the sealing member as seen from the direction of an arrow mark B in (A); FIG. 6(D) is a section of the sealing member at a line X—X in (A); and FIG. 6 (E) is a section of the sealing member at a line Y—Y in (A).

Figure 6:
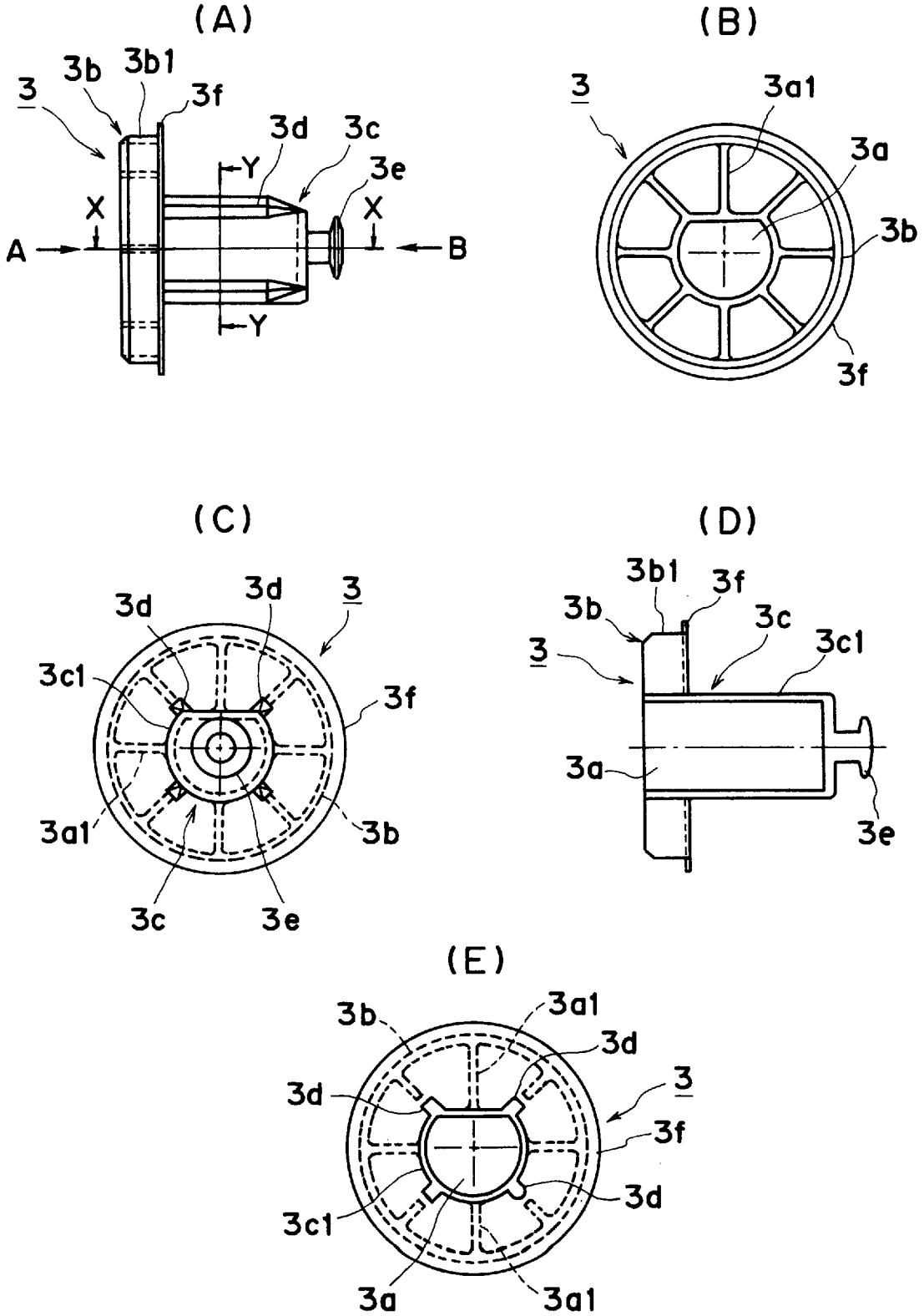
FIG. 6 illustrates a sealing member for the toner supply container, wherein (A) is a front view thereof, (B) is a view taken along a line A, (C) is a view taken along a line B in (A), (D) is a sectional view taken along a line X—X of (A), and (E) is a sectional view taken along a line Y—Y in (A).

In FIG. 6, (A, B, C, D and E), a reference character 3*b* designates an actual sealing portion of the sealing member 3, which is located on the toner supply container side of the sealing member to open or close the toner releasing opening 1*g* of the toner supply container 1. The external diameter of the sealing portion 3*b* is rendered slightly larger by an appropriate amount than the diameter of the toner releasing opening 1*g*, and the toner releasing opening 1*g* is sealed as the plug portion 3*b*1 of the sealing portion 3*b* is forced into the toner releasing opening 1*g* of the toner releasing portion 1*a*.

The reference character 3*c* designates a coupler portion, which constitutes a transmitting portion through which the sealing member 3 receives the force for driving the toner conveying member 2 from the main assembly 100. The coupler portion 3*c* comprises a shaft portion 3*c*1 and ribs 3*d*. The shaft portion 3*c*1 extends in the direction opposite to the container main body 1A, and the axial lines of the shaft portion 2A and the shaft portion 3*c*1 substantially coincide with each other. The ribs 3*d* are in the form of a spline, constituting the actual portions that receive the driving force. They are disposed on the peripheral surface of the shaft portion 3c1, extending in the longitudinal direction of the shaft portion 3c1 and radially projecting from the peripheral surface of the shaft portion 3c1, and engage with a first coupling member 5. In this embodiment, there are four ribs 3d, being evenly distributed around the peripheral surface of the shaft portion 3c1.

Further, the sealing member 3 comprises a female coupler portion 3a, which constitutes a portion that couples with the outward end portion 2a of the toner conveying member 2 to transmit the driving force received from the main assembly 100 to the toner conveying member 2. This female coupler portion 3a is constituted of the hole cut through the plug portion 3b1 and the male coupler portion 3c. The cross section of the female coupler portion 3a is in the form of a letter "D", which matches the shape of the cross section of the outward portion 2a of the toner conveying member 2, which projects outward from the toner releasing portion 1a. The cross section of the female coupler portion 3a is rendered slightly larger than that of the outward portion 2a of the toner conveying member 2 so that the outward portion 2a loosely fits in the female coupler portion 3a.

With the outward end portion 2a being loosely fit in the female coupler portion 3a, that is, the coupling hole 3a, the toner conveying member 2 and the sealing member 3 remain reliably engaged in terms of the rotational direction of the toner conveying member 2 while being allowed to freely slide relative to each other in the axial direction of the toner conveying member 2. Thus, as the toner supplying container is installed into the main assembly 100, the sealing member 3 and the container main body 1A can be separated to unseal (open) the toner releasing opening 1g, which will be described later.

The length by which the coupling hole 3a and the outward end portion 2a engage with each other is such that the coupling hole 3a and the outward end portion 2a do not become disengaged from each other when the actual sealing portion 3b of the sealing member 3 is separated from the container main body 1A. With this arrangement, even when the actual sealing portion 3b of the sealing member 3 is not in contact with the container main body 1A, the toner conveying member 2 is allowed to receive the driving force through the sealing member 3 (female coupler portion 3c).

The sealing member 3 also comprises a flange portion 3f, which is between the male coupler portion 3a and the actual sealing portion 3b, and comes in contact with the end portion of the toner releasing portion 1a when the actual sealing portion 3b is pressed into the toner releasing portion 1a. The external diameter of the flange portion 3f is substantially the same as that of the toner releasing portion 1a. With the presence of the flange portion 3f, the actual sealing portion 3b is pressed into the toner releasing portion 1a by the exact length of the plug portion 3b1.

Figure 7:
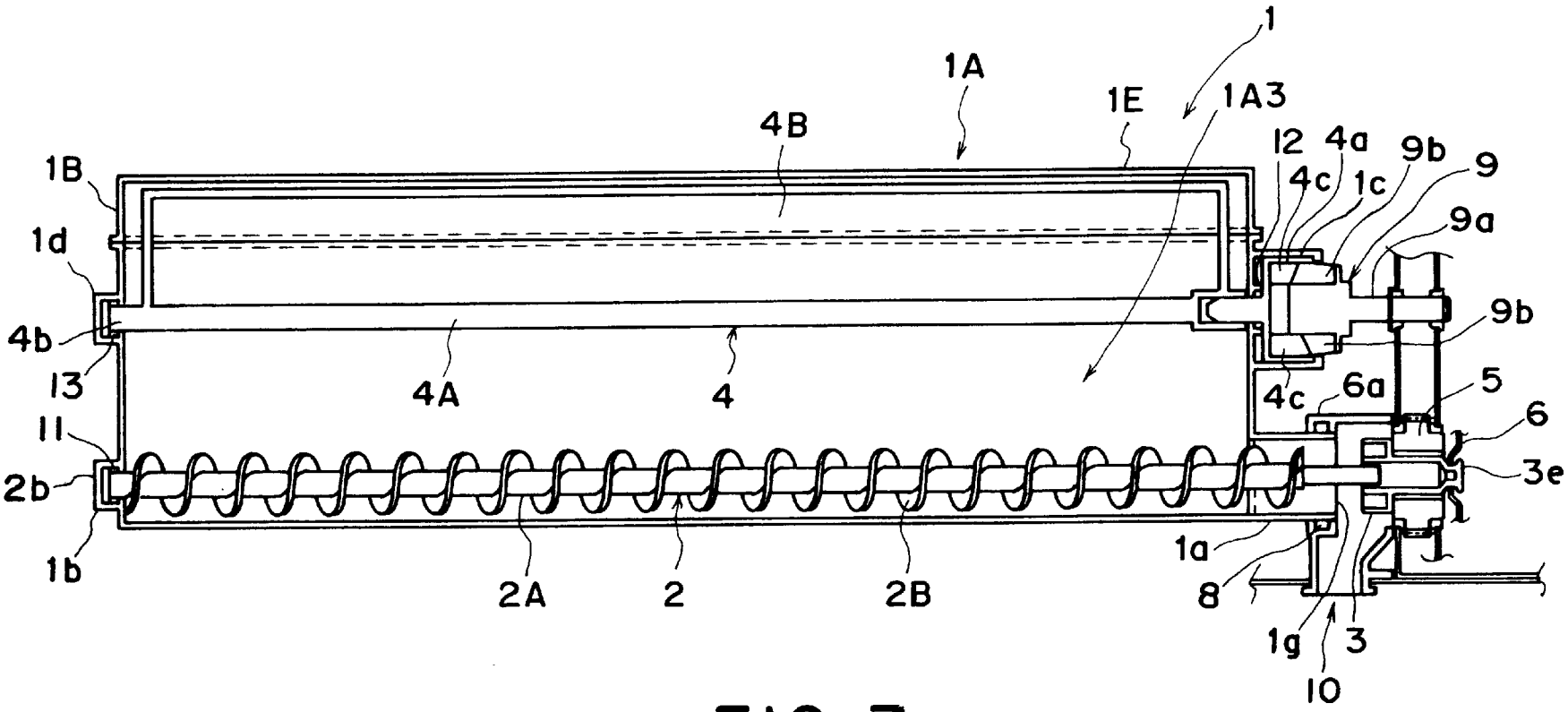
FIG. 7 is a sectional side view of the toner supply container which is mounted in the main assembly and which is unsealed.

The reference character 3e designates a projection, which is located at the tip of the male coupler portion 3c, and engages with a locking member 6 on the main assembly side as the toner supply container 1 is installed in the main assembly 100, as depicted in FIG. 7 and will be described later. With the projection 3e being engaged with the locking member 6, the sealing member 3 is kept immobilized while the toner releasing opening 1g is opened.

It is desirable that the sealing member 3 is also formed of plastic resin or the like by injection molding. However, material other than plastic resin, and a manufacturing method other then the injection molding may be employed. Further, the sealing member 3 may be constituted of two or more pieces, which are separately formed and then joined. The sealing member 3 needs to have a proper amount of elasticity so that it properly seals the toner releasing portion 1a when it is pressed into the toner releasing portion 1a. As for the material for the sealing member 3, low density polyethylene is most desirable, but polypropylene, nylon, high density polyethylene, or the like may also be used.

Next, the stirring member 4 will be described. The stirring member 4 is a member for stirring the powder toner stored in the toner storing portion 1A3 to break up the aggregation of the toner particles, and also to prevent the toner from becoming unevenly distributed in the toner storing portion 1A3; it is a member for releasing the powder toner from the toner storing portion 1A3 without allowing any portion of it to remain in the storing portion 1A3. The stirring member 4 is constituted of a shaft portion 4A, and a stirring blade portion 4B, which is attached to the shaft portion 4A, and breaks up the aggregation of the toner particles as it is rotated by the rotation of the shaft portion 4A.

The stirring member 4 is rotatively supported by the bearing portions 1c and 1d, by its longitudinal end portions 4a and 4b, respectively, of the shaft portion 4A. The bearing portions 1c and 1d are located above the toner releasing portion 1a and the bearing portion 1b, respectively. The stirring member 4 also comprises coupler claws 4c for receiving the rotational driving force from the main assembly 100. The coupler claw 4c is attached to a longitudinal end 4a, that is, the longitudinal end of the stirring member 4 on the toner releasing portion 1a side, which is supported by the bearing portion 1c.

The stirring member 4 is also desired to be formed of plastic resin or the like by injection molding. However, a material and a manufacturing method other than the ones described above may be employed. Further, the stirring member 4 may be constituted of two or more pieces, which are separately formed and then are joined together. The bearing portions 1c and 1d are provided with sealing member 12 and 13, respectively, which prevent the powder toner from entering the bearing portions 1c and 1d.

Next, the method for assembling the toner supply container 1 will be described.

In assembling the toner supply container 1, first, the toner conveying member 2 and the stirring member 4 are attached to the bottom frame 1K of the container main body 1A. Then, the top frame 1J of the container main body 1A is glued to the bottom frame 1K. As for the gluing method, various known methods may be used, but it is desirable to use ultrasonic welding since the ultrasonic welding is simple and also is better in terms of the airtightness of the toner supply container.

Next, a predetermined amount of toner is filled in the container main body 1A, and then, the toner releasing opening 1g is sealed with the sealing member 3 to complete the toner supply container 1. As is evident from the preceding description, the assembling of the toner supply container 1 is extremely simple, requiring only an extremely small number of steps.

Generally, the toner is fitted into the toner supply container 1 through the toner releasing opening 1g. However, the toner may be filled through a dedicated opening (unillustrated), which is made in the wall of the container main body 1A, at an optional location, and is sealed with a cap or the like after the filling of the toner. Further, the toner may filled into the bottom frame 1K of the container main body 1A before the top frame 1J is joined with the bottom frame 1K, after the toner conveying member 2, the stirring member 4, and the sealing member 3 are assembled into the bottom frame 1K.

Next, referring to FIG. 7, it will be described how the toner supply container 1 is installed into the main assembly 100.

First, the toner supply container replacement cover 15 of the main assembly 100 is opened and the toner supply container 1 is inserted into the main assembly 100. As the toner supply container 1 is inserted, the male coupler portion 3*c* of the sealing member 3 engages with the locking member 6 on the main assembly side. Then, the toner supply container replacement cover 15 is closed. As the cover 15 is closed, the toner supply container 1 is moved in the direction opposite to the direction in which the toner supply container 1 is inserted into the main assembly 100, by the opening-closing mechanism (unillustrated) on the main assembly 100 side. As a result, the sealing member 3 becomes separated from the toner releasing opening 1*g*.

During, and after, this movement of the toner supply container 1, the toner conveying member 2 and the sealing member 3 remain engaged in terms of their rotational directions. Further, during this movement of the toner supply container 1, the sealing member 3 engages with the first coupling member 5 on the main assembly 100 side, by the male coupler portion 3*c*. The first coupling member 5 is a coupler for transmitting the driving force of the driving apparatus (unillustrated) in the main assembly 100, to the sealing member 3.

Thus, the toner conveying member 2 is rotated by the rotational driving force received by the sealing member 3 from the main assembly 100, and steadily releases the toner into the main assembly 100 through the toner releasing opening 1*g*. In this embodiment, a toner sensor 114*g* is provided in the toner hopper portion, and as the toner sensor 114*g* detects the absence of the toner, the sealing member 3 is rotated, whereas as the toner sensor 114*g* detects the presence of the toner, the rotation of the sealing member 3 is stopped. In other words, the sealing member 3 is intermittently rotated in response to the toner consumption on the main assembly 100 side, and therefore, the toner is steadily but intermittently supplied to the main assembly 100. However, the entire amount of the toner in the toner supply container 1 may be dumped all at once into the main assembly 100 as the toner supply container 1 is installed into the main assembly 100.

Next, a method for replacing the toner supply container 1 will be described.

As substantially the entire amount of the toner in the toner supply container 1 is consumed through the image forming process, it is detected by a toner depletion detecting means (unillustrated), provided on the main assembly 100 side, that the entire amount of the toner in the toner supply container 1 has been depleted, and the user is informed of the depletion of the toner in the toner supply container 1 by a displaying means 100*b* (FIG. 11) such as a liquid crystal display.

In this embodiment, the toner supply container 1 is replaced by the user himself/herself. The steps for exchanging the toner supply container 1 are as follows.

Figure 13:
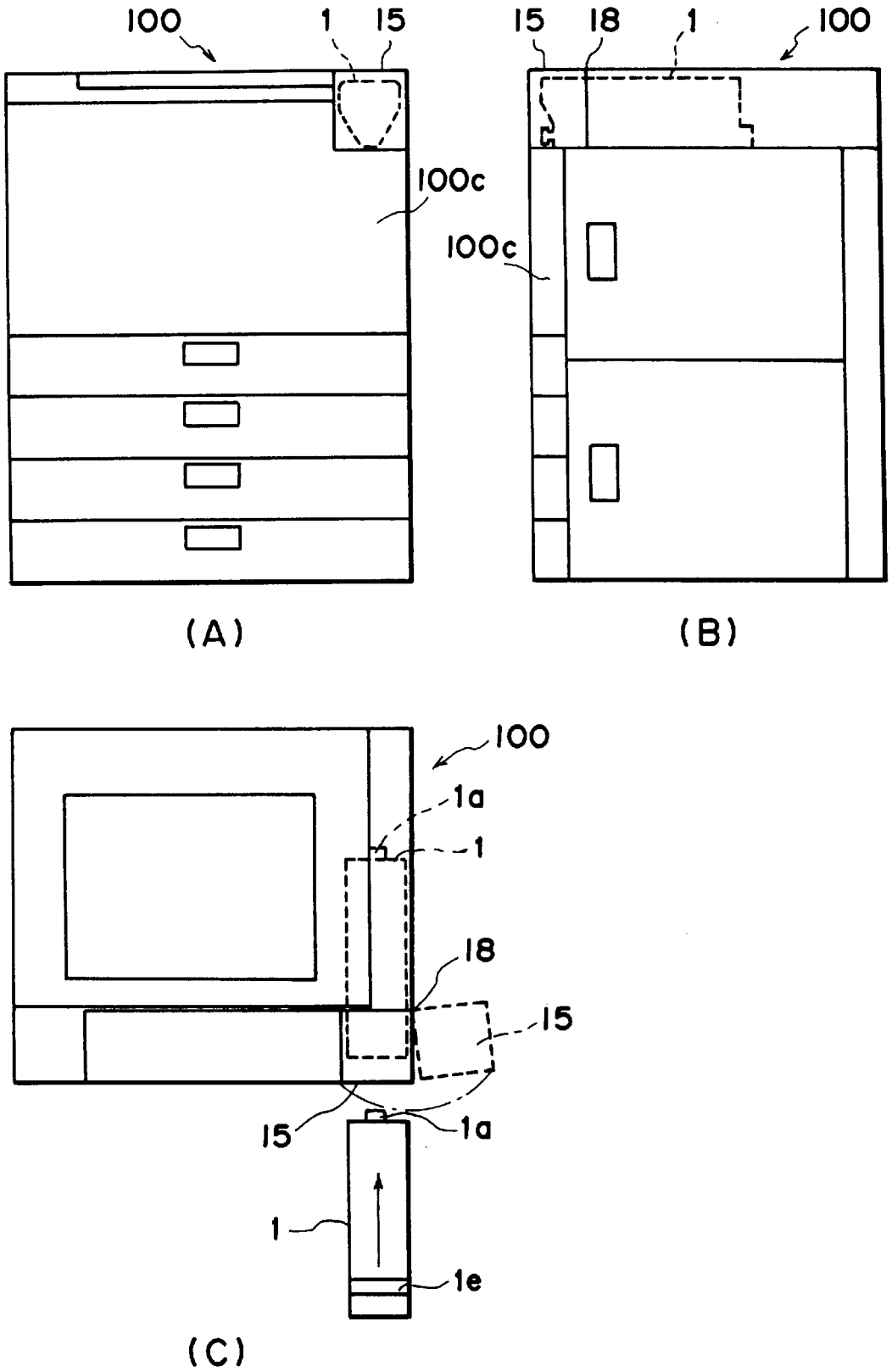
FIG. 13 shows a cover, for the toner-supply-container exchange, of said electrophotographic copying machine, wherein (A) is a side view thereof, (B) is a front view thereof, and (C) is a top plan view thereof.

First, the toner supply container replacement cover 15 which has remained closed as illustrated in FIG. 11, and FIG. 13, (A) and (B) is opened; it is rotated about a hinge 18 to a position indicated by a broken line, as depicted in FIG. 12 and FIG. 13, (C). Being linked to the opening movement of the toner supply container replacement cover 15, the sealing member 3, which has been separated from the container main body 1A by the movement of the container main body 1A, and has been at the position for keeping the toner releasing opening 1*g* open, is pressed into the toner releasing portion 1*a* by a means (unillustrated) for opening or closing the toner releasing portion 1*a*, and as a result, the toner releasing opening 1*g* is closed.

Next, the user removes the toner supply container 1, which has been illustrated in the main assembly 100, and has run out of the toner, out of the main assembly 100 by pulling the toner supply container 1 in the direction opposite to the direction indicated by an arrow mark in FIG. 13, (C). Thereafter, the user inserts a fresh toner supply container 1 into the main assembly 100 in the arrow direction, and closes the cover 15 (FIG. 13, (A) and (B)). Being linked to the closing movement of the cover 15, the sealing member 3 is separated from the container main body 1A by the means for opening/closing the toner releasing portion 1*a*, and as a result, the toner releasing opening 1*g* is unsealed. These are the steps for replacing the toner supply container 1.

Figure 8:
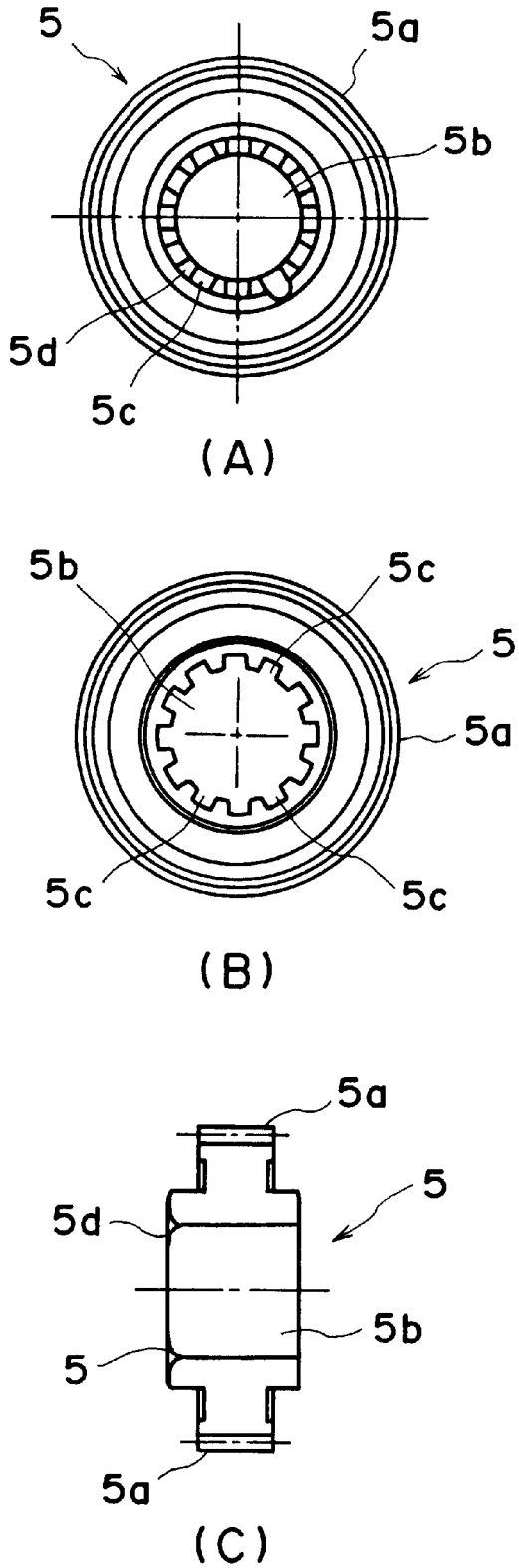
FIG. 8 illustrates a first coupling member of a electrophotographic copying machine, wherein (A) is a front view, (B) is a rear view and (C) is a sectional side view thereof.

FIG. 8 is a drawing for depicting the configuration of the first coupling member 5 in detail. FIG. 8, (A) is a front view of the coupler portion 5; (B) is a rear view of the coupler portion 5; and FIG. 3, (C) is a section of the coupler portion 5, parallel to the axial direction thereof. In FIG. 8, a reference character 5*a* designates a gear portion which constitutes the peripheral portion of the coupling member 5. The toner supply container 1 receives the driving force from the main assembly 100 through this gear portion 5*a*.

The reference character 5*b* designates a coupling hole which couples with the sealing member 3. The internal peripheral surface of the coupler hole 5*b* is provided with grooves 5*c*, which engage with one of the aforementioned spline-like projections 3*d* of the sealing member 3. One of the edges of the coupling hole 5*b*, that is, the edge which faces the toner supply container 1, is tapered, constituting a guiding portion 5*d*.

In this embodiment, the sealing member 3 is provided with four spline-like projections 3*d*, and the first coupling member 5 is provided with 12 engagement grooves 5*c*. Since the number of the engagement grooves 5*c* is rendered greater than that of the spline-like projections 3*c*, and also, the entrance side of the coupling hole 5*b* is provided with the guiding portion 5*d*, the sealing member 3 is reliably coupled with the first coupling member 5 even if the spline-like projections 3*d* and the engagement grooves 5*d* are misaligned in terms of rotational phase. It should be noted here that the number of the spline-like projections 3*d* of the sealing member 3 does not need to be limited to four; it is optional. Further, the number of the engagement grooves 5*c* does not need to be limited to 12; it is also optional.

The stirring member 4 engages with a second coupling member 9, that is, a member provided on the main assembly 100 side for driving the stirring member, by the engagement claw 4*c*, that is, a portion with which the longitudinal end 4*a* of the stirring member 4 is provided so that the stirring member 4 can engage with the second coupling member 9. The second coupling member 9 is a coupler for transmitting the driving force from the driving apparatus (unillustrated) on the main assembly 100 side, to the stirring member 4.

Figure 9:
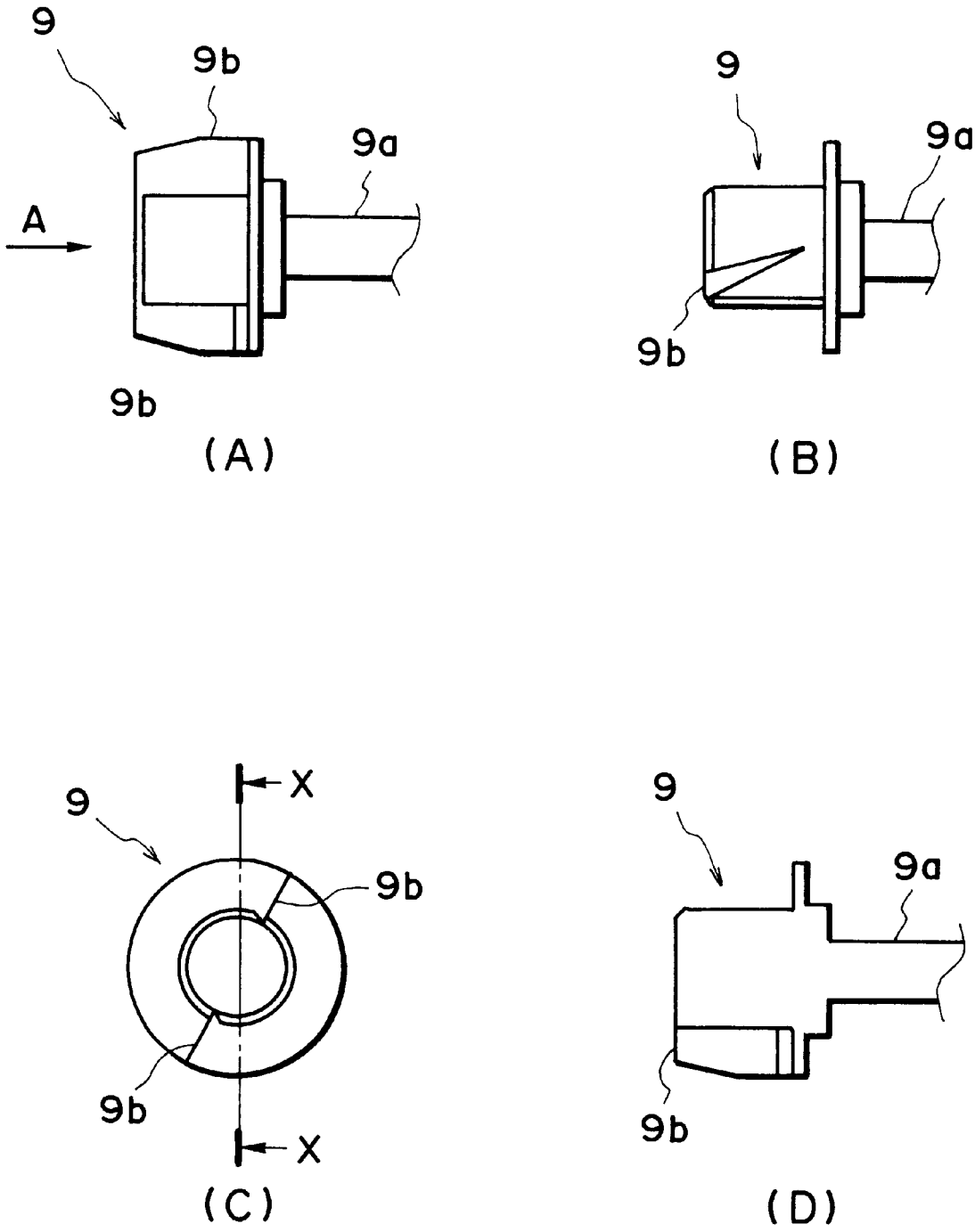
FIG. 9 illustrates a second coupling member of the electrophotographic copying machine, wherein (A) is a front view thereof, (B) is a top plan view thereof, (C) is a view taken along line A of (A), and (D) is a sectional view taken along a line X—X of (C).

FIG. 9 is a drawing for depicting in detail the configuration of the second coupling member 9. FIG. 9(A) is a side view of the second coupling member 9; FIG. 9(B) is a plan view thereof, as seen from the top or bottom direction in (A); FIG. 9(*c*) is a plan view thereof as seen from the direction of an arrow mark A in (A); and FIG. 9(D) is a section thereof at a line X—X in (C).

In the drawings, a reference character 9*a* designates a shaft portion, which is the main assembly side of the coupling member 9, and through which the force for driving the stirring member 4 is transmitted from the main assembly 100 to the stirring member 4. A reference character 9*b* designates an engagement claw, which radially projects from the peripheral surface of the toner supply container 1 side of the second coupling member 9, being slightly angled relative to the axial line of the second coupling member 9, and transmits the driving force received from the main assembly 100 by the shaft portion 9*a*, to the stirring member 4. The second coupling member 9 has two engagement claws 9*b*.

As the shaft portion 9*a* is rotated by the driving force from the main assembly 100, with the engagement claw 9*b* being engaged with the engagement claw 4*c* of the stirring member 4, the second coupling member 9 is rotated, which in turn rotates the stirring member 4.

The engagement claws 9*b* and 4*c* of the second coupling member 9 and the stirring member 4, respectively, are structured so that even if the engagement claws 9*b* and 4*c* are misaligned in terms of the rotational phase at the moment when the toner supply container 1 is installed, they are automatically aligned and reliably engaged.

As the toner supply container 1 is installed into the main assembly 100, the toner releasing portion 1*a* of the toner supply container 1 is held in a holder 6*a* of the main assembly 100, and the gap between the external peripheral surface of the toner releasing portion 1*a* and the internal peripheral surface of the holder 6*a* is sealed by a circular sealing member 8.

Next, the releasing of the toner will be described.

The first coupling member 5 receives the rotational driving force from a power source (unillustrated) such as an electric motor on the main assembly 100 side through a power transmitting means (unillustrated) such as a gear. The driving force received by the first coupling member 5 is transmitted to the sealing member 3 through the engagement between the groove 5*c* and the spline-shaped project 3*d*. The driving force transmitted to the sealing member 3 is further transmitted to the toner conveying member 2 through the engagement between the coupling hole 3 with the "D"-shaped cross section and the outward end 2*a* with the "D"-shaped cross section.

The second coupling member 9 receives the driving force also from the power source (unillustrated), such as an electric motor on the main assembly 100 side through a power transmitting means (unillustrated) such as a gear. Since the claws 9*b* and 4*c* are engaged with each other, the driving force transmitted to the second coupling member 9 is transmitted to the stirring member 4, and rotates the stirring member 4. As the stirring member 4 is rotated, the toner particles which have aggregated due to the vibration which occurred during the transportation of the toner supply container 1, or due to escaping of the air from the toner, which occurred while the toner supply container 1 was stored for a long period of time, are dispersed to prevent such problems as "bridging".

In this embodiment, the number of the revolutions for the toner conveying member 2 and the stirring member 4 are set at approximately 37/min and 8/min, respectively.

The toner, the particles of which have been separated by the stirring member 4, is conveyed toward the toner releasing opening 1*g* as the toner conveying member 2 is rotated. Then, it is released from the toner releasing opening 1*g*, falling into the toner hopper 114*a* of the main assembly 100 through the toner receiving opening 10 of the main assembly 100.

As described previously, the section between the toner releasing opening 1*g* and the toner receiving opening 10 is airtightly sealed by the sealing member 8, and therefore, the toner particles released from the toner releasing opening 1*g* are prevented from leaking and scattering into the internal space of the main assembly 100.

In this embodiment, the toner supply container 1 is designed so that the sealing member 3 is retained immediately outside of the toner releasing opening 1*g*. With this arrangement, a proper distance necessary for preventing the sealing member 3 from preventing the toner from being released from the toner releasing opening 1*g* by the amount in accordance with the flocculency of the toner can be maintained between the sealing member 3 and the toner releasing opening 1*g*. As a result, clogging of the toner releasing portion 1*a* adjacent to the toner releasing opening 1*g*, and various problems resulting from the clogging can be prevented.

Further, the force for driving the stirring member 4 and the force for driving the toner conveying member 2 are separated on the main assembly 100 side, and are independently transmitted to the stirring member 4 and the toner conveying member 2. Therefore, an area in which the gears or the like rub against each other, that is, the joints through which the driving force from the main assembly 100 side is transmitted to the toner supply container 1, is not in the space in which the toner is stored. Thus, the toner particles are not caused to fuse into larger particles.

Further, the arrangement that separates, on the main assembly 100 side, the force for driving the stirring member 4 and the force for driving the toner conveying member 2 can reduce the cost of the toner supply container 1, and also reduces the cost for operating the printer, compared to an arrangement that divides, within the container main body 1A, the driving force from the main assembly 100.

Next, the second embodiment of the present invention will be described.

Figure 10:
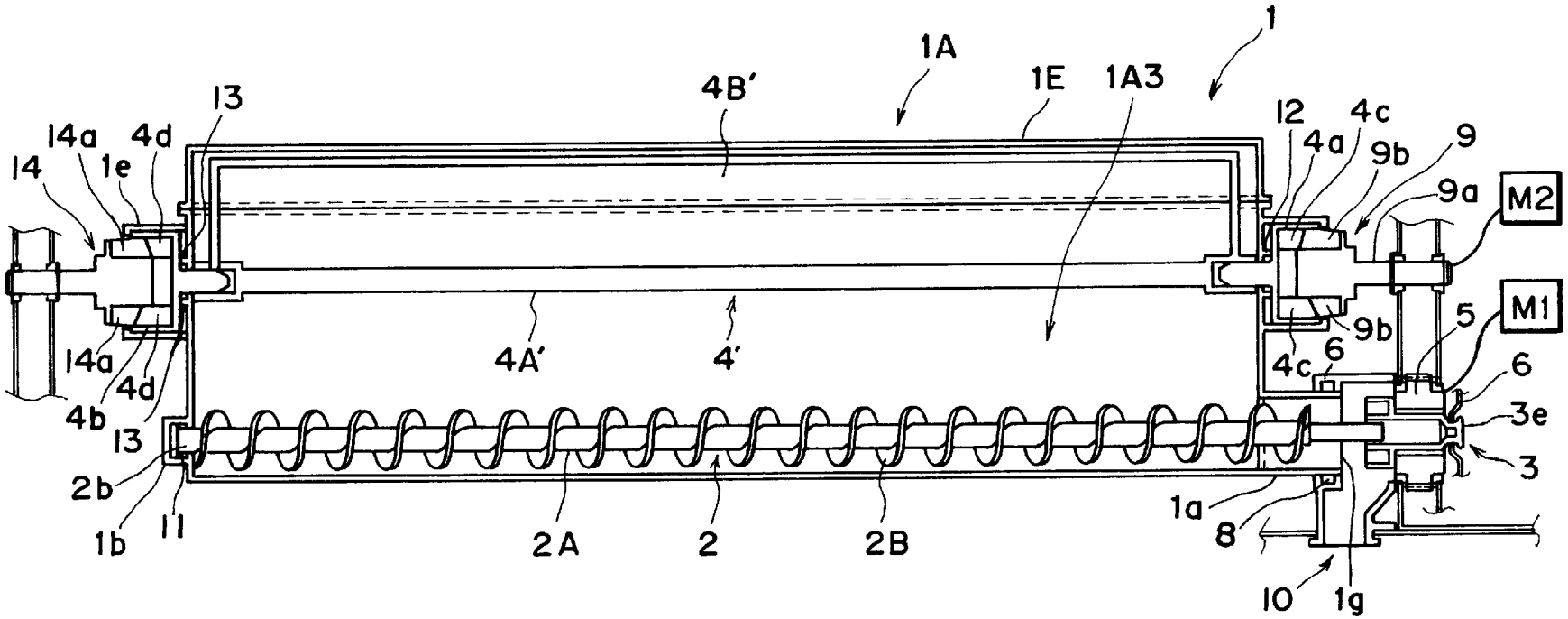
FIG. 10 is a sectional side view of a toner supply container according to a second embodiment of the present invention, which is mounted in the main assembly of the electrophotographic copying machine and which is unsealed.

FIG. 10 is a vertical section of the toner supply container, parallel to the longitudinal direction of the container, in the second embodiment of the present invention. In the drawing, the container is in the main assembly of an electrophotographic copying machine, and is open. The reference characters in the drawing, which are the same as those in FIG. 7, designate corresponding components and sections.

In FIG. 10, a reference numeral 4' designates a stirring member, which in this embodiment is driven from both of the longitudinal end portions 4*a* and 4*b* of its shaft portion. The end portions 4*a* and 4*b* are provided with engagement claws 4*c* and 4*d*, respectively, for receiving the rotational driving force from the main assembly 100, and are supported by the bearing portions 1*c* and 1*e*, respectively, of the toner supply container 1.

As the toner supply container 1 is installed into the main assembly 100, the engagement claws 4*c* at the longitudinal end portion 4*a* of the stirring member 4 engages with the engagement claw 9*b* of the second coupling member 9 on the main assembly 100 side, and the engagement claw 4*d* of the other longitudinal end 4*b* of the stirring member 4 engages with the engagement claw 14*a* of a third coupling member 14 which is the same in configuration as the second coupling member 9 (FIG. 9).

Also in this embodiment, the toner supply container 1 and the main assembly 100 are designed so that even if the engagement claws 4*c* and 4*d* of the stirring member 4', and the engagement claws 9*b* and 14*a* of the second and third coupling members 9 and 14, respectively, are misaligned in terms of their rotational phase at the moment when the toner supply container 1 is installed into the main assembly 100, they are automatically aligned to be reliably engaged, as described in the first embodiment.

Also in FIG. 10, a reference character M1 designates a first motor, which is disposed in the main assembly 100 to rotatively drive the toner conveying member 2, and a reference character M2 designates a second motor, which is also disposed in the main assembly 100 to rotatively drive the stirring member 4' by the transmitting the driving force to the stirring member 4' from both of the longitudinal ends of the stirring member 4'.

Next, the releasing of the toner will be described.

The first coupling member 5 receives the rotational driving force from the first motor Ml on the main assembly 100 side through a power transmitting means (unillustrated) such as a gear. The driving force received by the first coupling member 5 is transmitted to the sealing member 3 through the engagement between the groove 5*c* and the spline-shaped project 3*d*. The driving force transmitted to the sealing member 3 is further transmitted to the toner conveying member 2 through the engagement between the coupling hole 3 with the "D"-shaped cross section and the outward end 2*a* with the "D"-shaped cross section.

The second and third coupling members 9 and 14 receive the driving force from the second motor M2 on the main assembly 100 side through a power transmitting means (unillustrated) such as a gear. The driving force received by the second and third coupling members 9 and 14 is transmitted to the stirring member 4' through the engagement between the engagement claw 4*c* of the stirring member 4' and the engagement claw 9*b* of the second coupling member 9, and also through the engagement between the engagement claw 4*d* of the stirring member 4' and the engagement claw 14*a* of the third coupling member 14.

In this embodiment, as a signal for driving the toner supply container 1 in the main assembly 100 is inputted in the printer, first, the stirring member 4' is rotated for a predetermined length of time, and then, the stirring member 4' and the toner conveying member 2 are rotated together. Further, as a signal for stopping the driving of the toner supply container 1 in the main assembly 100 is inputted in the printer, the stirring member 4' and the toner conveying member 2 are stopped at the same time, or the stirring member 4' is stopped a predetermined period of time after stopping the toner conveying member 2.

With this arrangement of rotating the stirring member 4' for a predetermined length of time before starting to rotate the toner conveying member 2 and after stopping the rotation of the toner conveying member 2, the toner particles, which have aggregated, are always dispersed before, while, and after the toner is released. Thus, even if a toner supply container is stored for a long period of time, or is subjected to vibration of undesirable ambient conditions (high temperature, and high humidity) during its transportation, and as a result, the air contained in the toner escapes to allow the toner particles to densely flocculate, the toner can be accurately released from the toner supply container at a predetermined rate.

Thus, the same effects as those described in the first embodiment can be obtained in this embodiment. Further, the stirring member 4' in this embodiment is driven from both of its longitudinal ends, and therefore, the torsional force to which the stirring member 4' is subjected is not as large as the torsional force to which the stirring member 4 in the first embodiment is subjected. Therefore, the material used for the stirring member 4' may be less resistant to torsional force than the material for the stirring member 4 in the first embodiment; in other words, cheaper material can be used as the material for the stirring member 4'.

Further, the means for transmitting the driving force to both longitudinal ends of the stirring member 4' is disposed on the main assembly 100 side instead of being on the toner supply container 1 side, and therefore, the cost of the toner supply container 1 is low, which in turn reduces the operational cost of the printer.

Further, the number of revolutions of the stirring member 4' and the toner conveying member 2 are rendered adjustable so that they can be varied in response to the required image density. Therefore, the power consumption of the power sources (motors M1 and M2) can be reduced to reduce the operational cost of the printer.

A third embodiment of the present invention will be described.

In this embodiment, a feeding member and a stirring member, which is a separate member from the feeding member, are provided.

Figure 14:
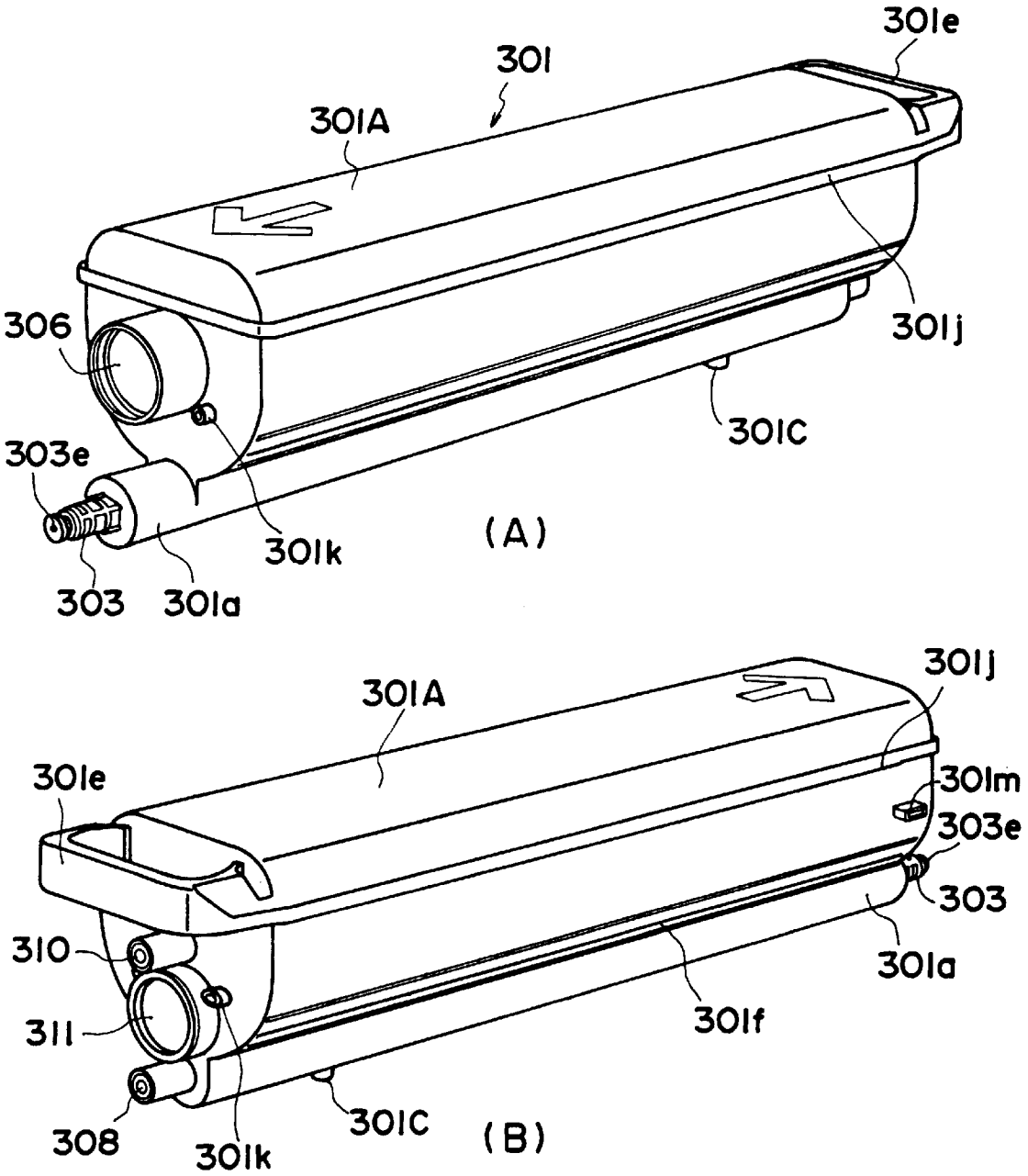
FIG. 14 shows a toner supply container according to a third embodiment, wherein (A) is a perspective view as seen from the side near a sealing member, and (B) is a perspective view as seen from the side near a handle.

FIG. 14 is a perspective view of a toner supply container 301 according to the third embodiment of the present invention.

Figure 15:
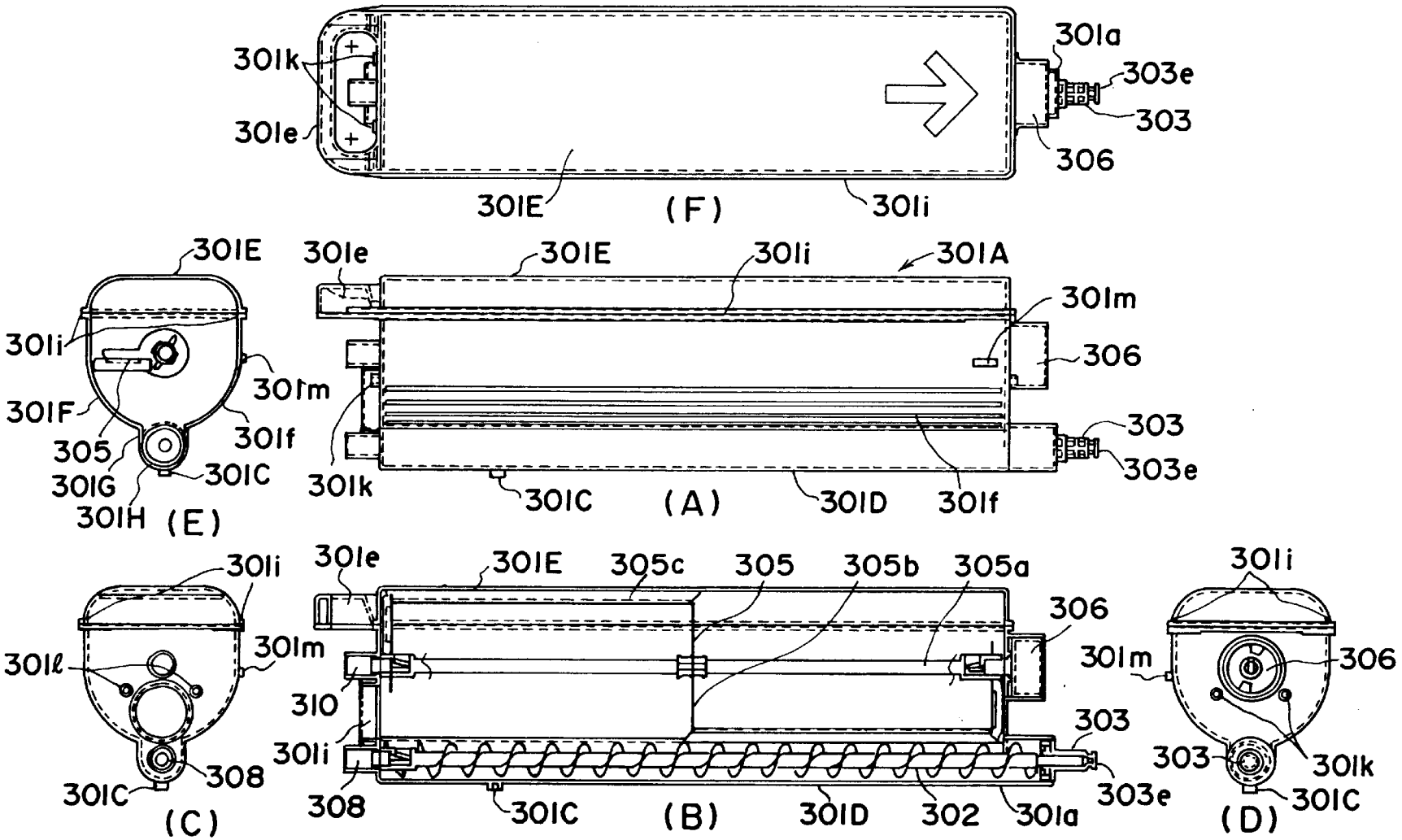
FIG. 15 shows a toner supply container according to a third embodiment, wherein (A) is a front view thereof, (B) is a sectional view thereof, (C) is a left side view thereof, (D) is a right side view thereof, (E) is a sectional side view thereof, and (F) is a top plan view thereof.
Figure 16:
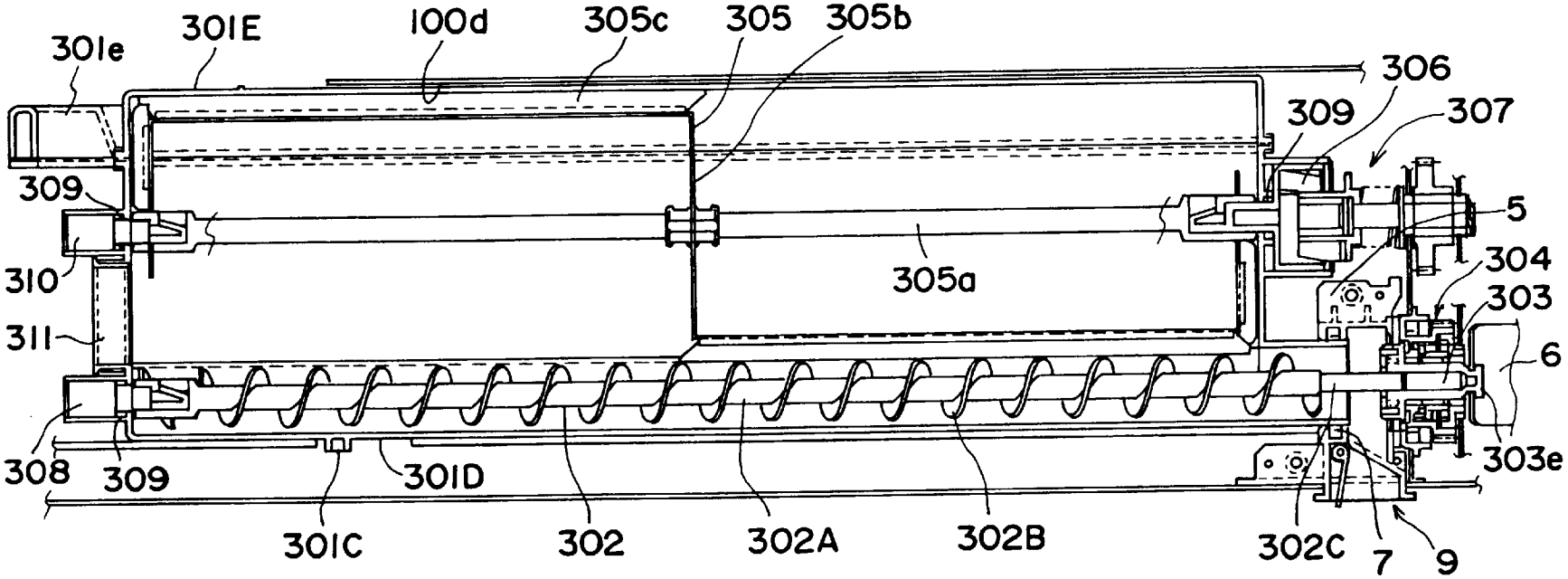
FIG. 16 is a sectional front view of a toner supply container which is placed in the main assembly of the apparatus and a supply port of which is in the unsealed state.
Figure 17:
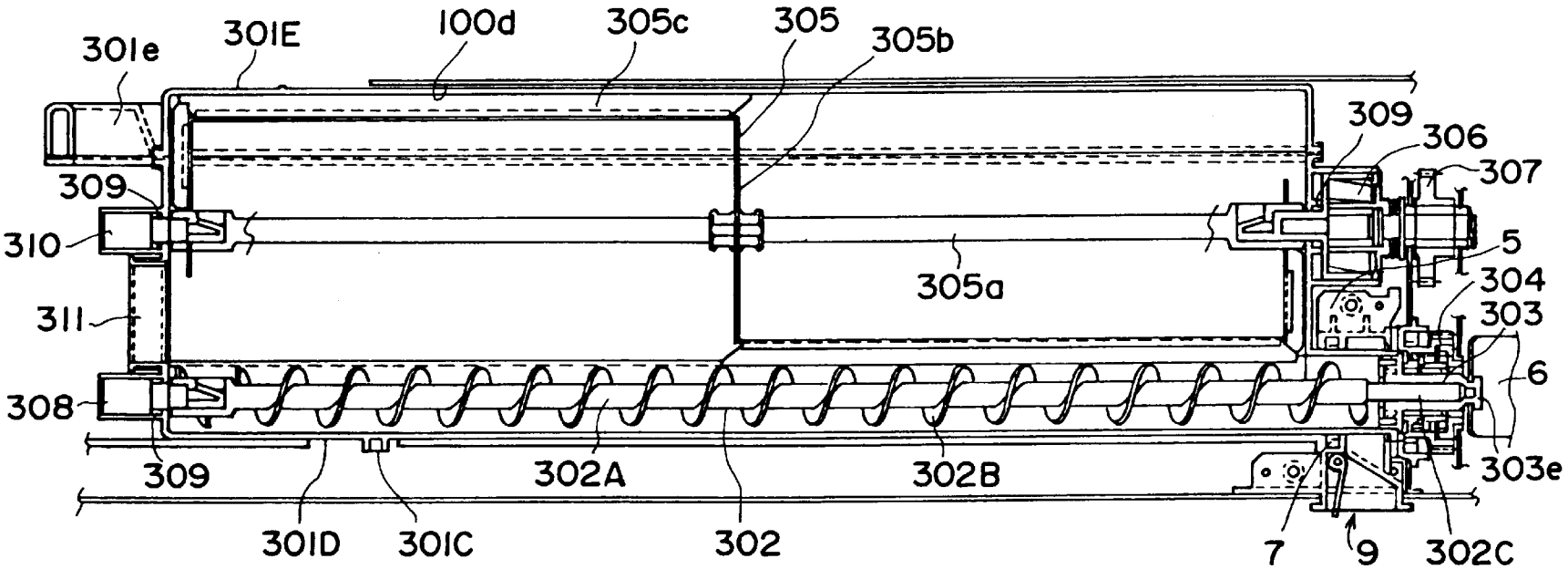
FIG. 17 is a sectional front view of a toner supply container which is placed in the main assembly of the apparatus and a supply port of which is in the unsealed state.

FIG. 15, (A) is a front view of the toner supply container according to this embodiment, and FIG. 15(B) is a sectional view. FIG. 15(C) is a left side view of the toner supply container, FIG. 15(D) is a right side view of the toner supply container, FIG. 15(E) is a sectional side view of the toner supply container, and the FIG. 15(F) is a top plan view of the toner supply container. FIG. 16 is a sectional front view wherein the toner supply container is loaded in the main assembly 100 of the apparatus, and the supply port is open. FIG. 17 is a sectional front view wherein the toner supply container is loaded in the main assembly 100 of the apparatus, and the supply port is sealed.

In FIGS. 14–17, designated by 301A is a main assembly of the container, and 302 is a feeding member for feeding the toner accommodated in the main body 301A of the container toward the toner supply port portion 301*a*. Designated by 303 is a sealing member for sealing the toner supply port 301*g*, and 304 is a coupling member for transmitting the driving force to the sealing member 303 when the toner supply container is mounted to the main assembly 100 of the apparatus. Designed by 305 is a stirring member for stirring the toner in the main body 1A. Designated by 306 is a transmitting member engageable with the stirring member 305 to transmit the rotation force from the image forming apparatus to the stirring member. Designated by 307 is a second coupling member for transmitting the driving force to the transmitting member 306 when the toner supply container is mounted to the main assembly 100.

Designated by 309 is an oil seal for preventing leakage of the toner.

Figure 18:
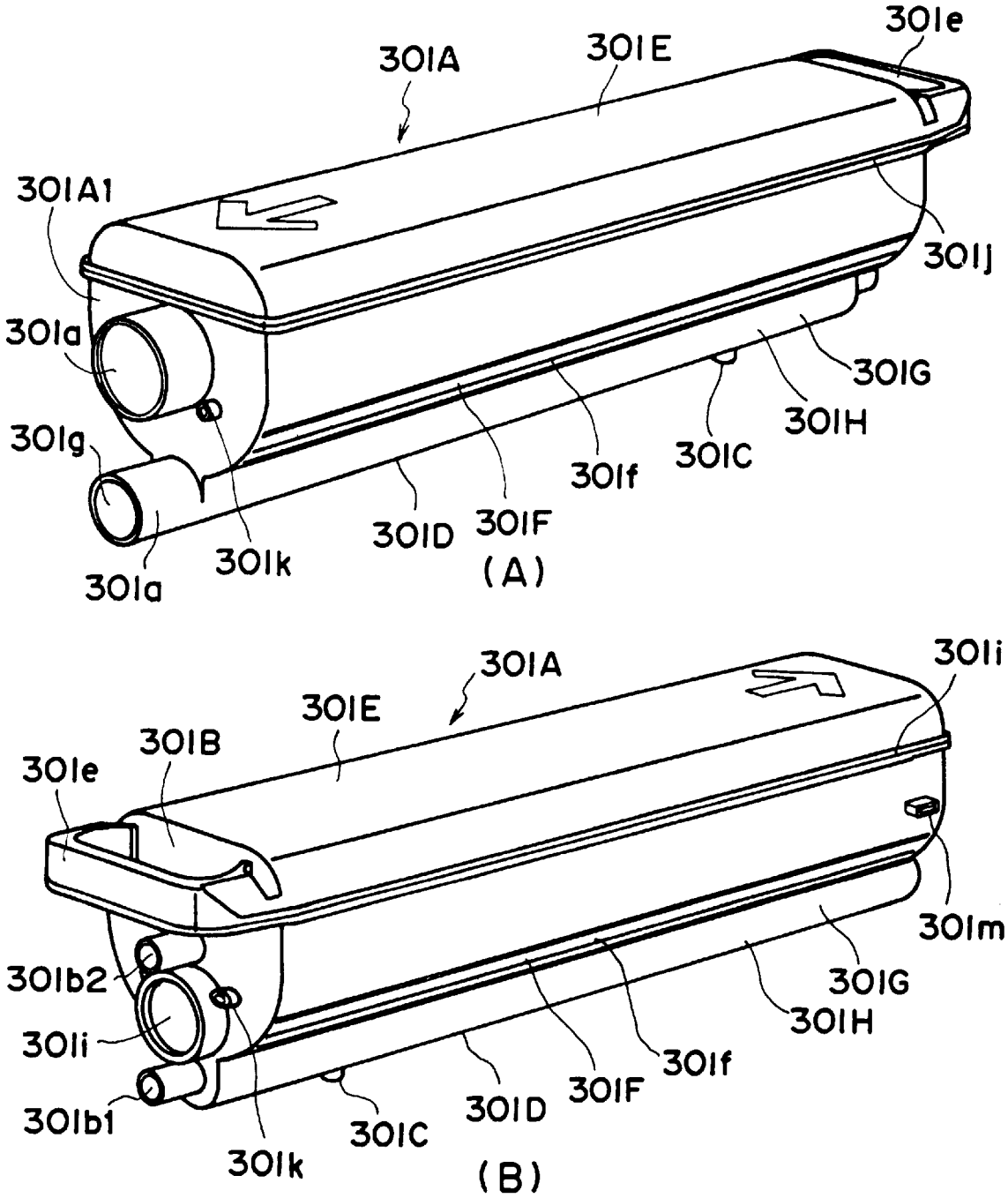
FIG. 18 shows a toner accommodating part according to the third embodiment, wherein (A) is a perspective view as seen from a side near a supplement port, and (B) is a perspective view as seen from a side near a handle.
Figure 19:
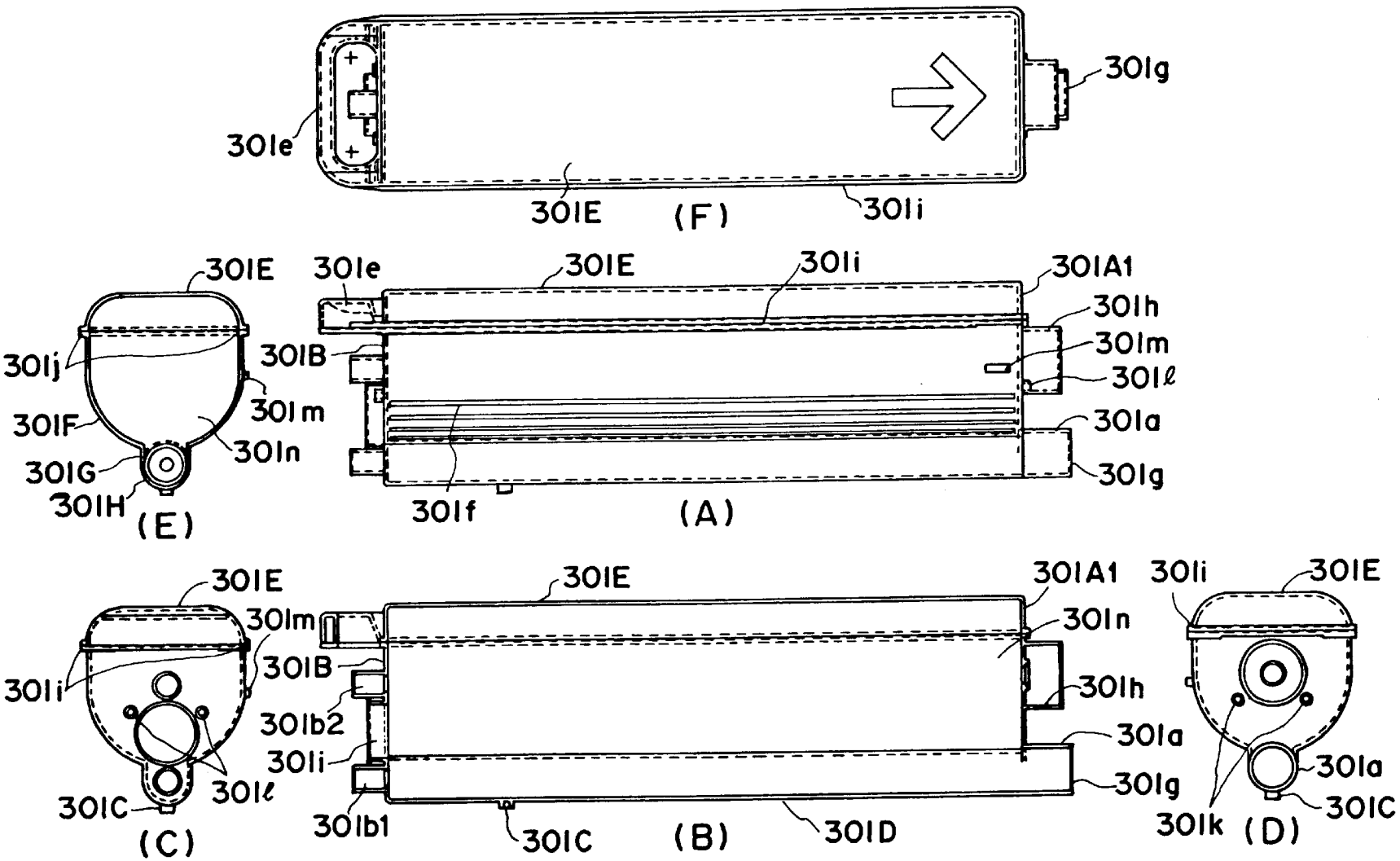
FIG. 19 shows a toner accommodating part, wherein (A) is a front view thereof, (B) is a sectional view thereof, (C) is a left side view thereof, (D) is a right side view thereof, (E) is sectional side view thereof, and (F) is a top plan view thereof.

Referring to FIG. 18 and FIG. 19, the toner supply container part 301A, which is a main assembly of the toner supply container, will be described. FIG. 18 is a perspective view of the main assembly of the container.

FIG. 19, (A) is a front view of the main assembly of the container, FIG. 19(B) is a sectional view, FIG. 19(C) is a left side view, FIG. 19(D) is a right side view, FIG. 19 (E) is a cross-sectional view, and FIG. 19(F) is a top plan view.

The main body 1A of the toner supply container includes a curved portion 301F having a width decreasing toward the lower portion, a flat surface portion 301G having a substantially constant width extending from the lower portion of the curved portion, and an arcuate configuration portion 301H extending from the lower portion of the flat surface portion.

At a lower portion of one side surface 1A1 of the main body 301A of the container, a cylindrical member defining a toner supply port portion 301*a* is projected which functions to supply toner accommodated in the toner accommodating portion in to the main assembly of the apparatus. A toner supply port 301*g* is provided at one end portion of the toner supply port portion 301*a*. At a position corresponding to the toner supply port portion 301*a* of the other side surface 301B, a first receiving portion 301*b*, for rotatably supporting the feeding member 2, is formed. Outside the 301D, there is provided an engaging portion 301*c* for engaging with the toner supply port opening and closing means provided in the main assembly 100 to move the toner supply container 301 in the mounting and demounting direction. In this embodiment, the engaging portion 301C is in the form of a dowel projected outwardly from the lower surface handle 301D. The upper surface 301E is provided with a handle 301*e* for facilitating mounting of the toner supply container 391 to the main assembly 100 and removal thereof from the main assembly 100. The lower inclined surface (curved portion) 301F of the front side and the rear side is provided grooves 301*f* extending substantially parallel with each other in the longitudinal direction of the container to facilitate handling of the main body 1A of the container when the toner supply container 1 is mounted to the main assembly 100 of the apparatus.

Above the first receiving portion 301*b*1 of the other side surface 301B, there is provided a second receiving portion 301*b*2 for rotatably supporting the stirring member 305.

The toner supply port portion 301*a* is disposed in a side surface 301A1 opposite from the side surface 301B having the handle 301*e* in the longitudinal direction of the main body 301A. By this arrangement, when the user mounts the toner supply container 301 to the main assembly 100, the user is prevented from inadvertently touching the toner supply port portion 301*a*. The toner supply port portion 301*a* is located at the lower position of the side surface 301A1. Therefore, even if the amount of the toner accommodated in the main body 301A becomes small, the toner can be discharged efficiently.

The toner supply port portion is projected from the side surface 301A by 20 mm–40 mm, preferably approximately 27.8 mm. The toner supply port portion 301*a* is cylindrical in shape, and the outer diameter of the cylindrical portion is 20 mm–30 mm, preferably approximately 27.6 mm.

As described hereinbefore, an engagement portion 301C is provided on the outside of the lower surface 301D. The engaging portion 301C is correctly positioned by a locking portion 51C (FIG. 8) provided in the main assembly 100 of the apparatus when the toner supply container is mounted to the main assembly 100. The engaging portion 301C, as described hereinbefore, is in the form of a columnar projection (dowel) projecting outwardly from the lower surface 301D. The circular column shape portion has an outer diameter 8 which is 5 mm–12 mm, preferably approximately 8 mm. The positioning portion is disposed at a position 2 mm—mm away from the lower surface 301D, and the engaging portion 301C (positioning portion) is disposed at a position 60 mm–80 mm preferably approximately 71 mm away from the lateral end surface 301B opposite from the side of the toner supply port portion 301*a* in the longitudinal direction of the lower surface 301D.

The side surface 301A1 and the other side surface 301B, are each provided with two bosses 301*k*, 3011 for positioning the main assembly of the container when the dimensional inspection for the main assembly of the container is carried out before the container is delivered from a plant.

Designated by 301*m* is a rib for preventing erroneous mounting.

The user is prevented from mounting an erroneous container by disposing the rib 301*m* at different positions for the toner supply containers.

The main body 301A is preferably manufactured through an injection molding of resin material, such as plastic resin material, blow molding or injection blow molding, but another material and/or another manufacturing method is also usable. The main body 301A of the container may be divided into two or more portions, which are unified by welding, bonding or the like.

In the embodiment, the upper frame and lower frame of high impact polystyrene are unified by vibration welding.

The feeding member 302, as shown in FIG. 16, includes a shaft portion 302A and a helical rigid feeding blade 302B, on the shaft portion 302A, which functions as a feeding portion for feeding the powder toner in a predetermined direction by rotation of the shaft portion 302A. The feeding member 302 is mounted to the main body 301A of the container with the axis of the shaft portion 302A substantially aligned with the center of the substantially circular toner supply port 301*g*.

The feeding member 302 is not limited to the screw type, as described above, but a flexible blade may be mounted to the shaft portion 302A, for example. The shaft portion and the blade may be integrally molded, and may be separate members. In this embodiment, the shaft portion 302A and the blade 302B are made of plastic resin material molded integrally.

In the embodiment, the feeding member 302 has an extending potion 302C extending into the cylindrical portion of the toner supply port portion 301*a*. In this embodiment, the extending portion 302C is further extended out of the toner supply port portion 301*a*. A free end portion of the extended-out portion of the extending portion 302C receives the rotation force from the main assembly 100. Therefore, in this embodiment, the sealing member 303 is movably (in the axial direction) mounted to the free end portion.

One end portion 302*a* of the extending portion 302C has a configuration, such as a polygonal configuration, and more particularly, a rectangular configuration, to receive the rotation force through the sealing member 303 from the main assembly 100. The one end portion of the shaft portion 302A is supported on the sealing member 303 through one end portion 302*a* of the extending portion 302C. The other end portion 302*b* of the shaft portion 302A is provided with a first bearing member 308. It is supported rotatably (upon unsealing) to the main body 301A through the first bearing member 308.

The feeding member 302 is supported on the sealing member 303 such that feeding blade 302B is out of contact with the internal wall surface 301*a*1 of the toner supply port portion 301*a* and that internal wall surface of the toner supply port portion 301*a* is substantially parallel with the shaft portion 302*a*. By supporting the feeding member 302 in this manner, the toner can be fed substantially horizontally to the toner supply port 301*g* by rotation of the feeding member 302. It is possible that fine toner particles enter between the feeding blade 302B and the internal wall surface 301*a*1 of the toner supply port portion 301*a* and are fused on the internal wall surface 301*a*1 by strong rubbing therebetween with the result that massive toner particles are produced. However, this can be avoided by supporting the feeding member 302 in that manner.

The feeding member 2 is also preferably manufactured through injection molding or the like of plastic resin material or the like, but another method and/or another material is also usable. It may be made of separate members which are connected.

Figure 20:
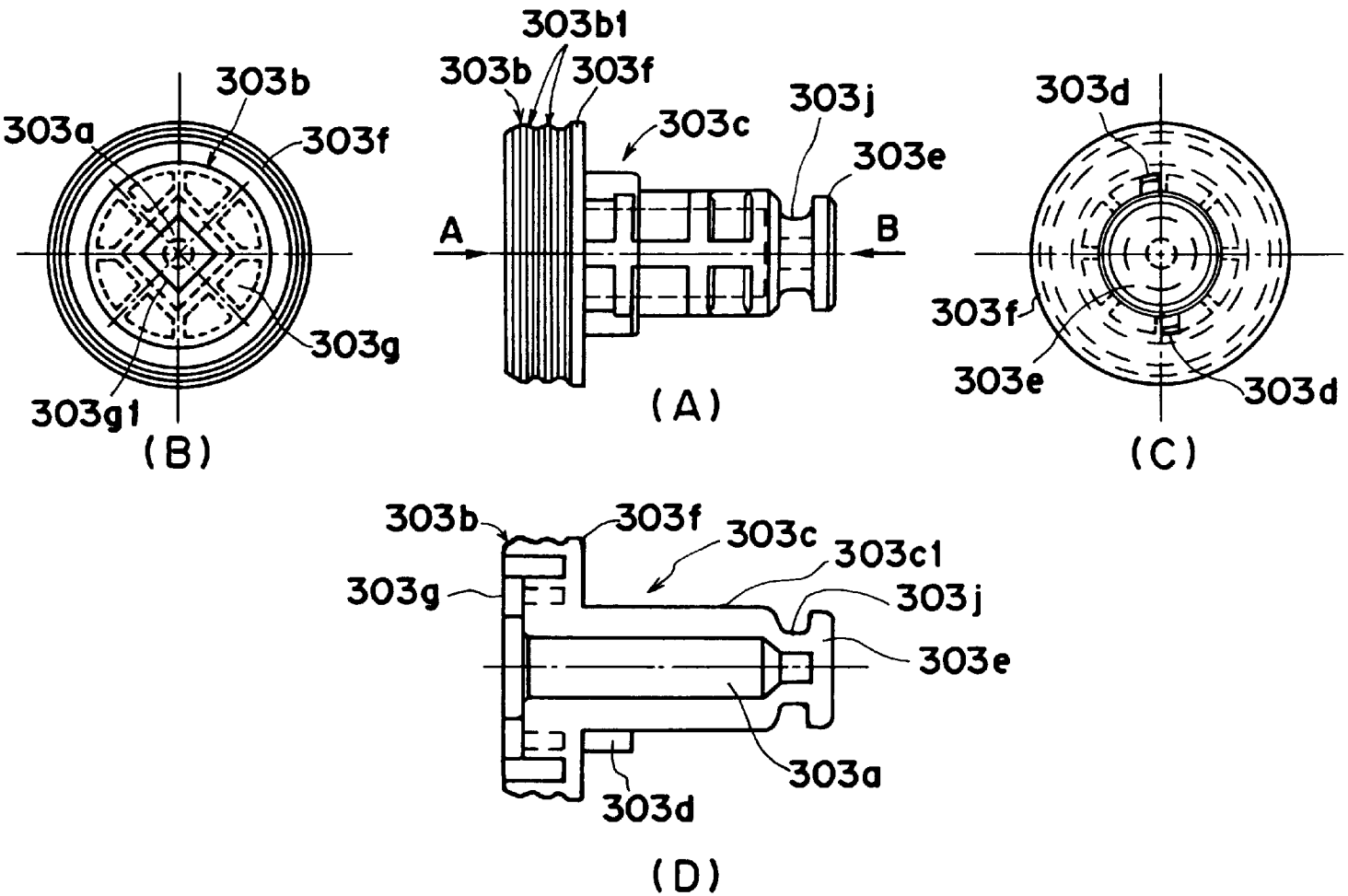
FIG. 20 shows a sealing member, wherein (A) is a front view thereof, (B) is a view taken along a line (A), (C) is a view taken along a line B, and (D) is a sectional front view thereof.

Referring to FIG. 20, a description will be provided as to a sealing member 303. In FIG. 20, FIG. 20(A) is a front view of a sealing member, FIG. 20(B) is a view taken along a line A—A, FIG. 20(C) is a view taken along a line B—B, and FIG. 20(D) is a sectional front view.

In (A)–(D) of FIG. 20, designated by 303*b* is a sealing portion which is provided at a side opposite from the toner supply container 301 of the sealing member 303 to openably seal the toner supply port 301*g* of the toner supply container 301. The outer diameter of the sealing portion 303*b* is larger than an inner diameter of the toner supply port 301*g* by a proper amount. The sealing member 303 hermetically seals the toner supply port 301*g* by press-fitting the engaging portion 303*b*1 of the sealing portion 303*b* into the toner supply port portion 301*a* from the toner supply port 301*g*.

Designated by 303*c* is a coupling engaging portion which functions as a driving force receiving portion (driver) for receiving the driving force for rotating the feeding member 302 from the main assembly 100 of the apparatus when the toner supply container 301 is mounted to the main assembly 100. The coupling engaging portion 303*c* is provided with a projected portion 303*c*1 extending from the sealing portion 303*b* substantially co-axial with the axis of the shaft portion 302A of the feeding member 302 in the direction opposite from the main body 301A of the toner container (when the sealing member 303 is mounted on the main body 301A of the container). The coupling engaging portion 303C is provided on the curved surface of the projected portion 303*c*1, and is provided with elongated projections (ribs) 303*d* (spline-like), which functions as a driving force receiving portion engageable with the coupling member 304. In this embodiment, two of such spline projections 303*d* are provided equidistantly.

More particularly, they are disposed at an approximately 180° interval.

The rib 303*d* is projected from the outer surface of the sealing member by 0.5 mm–3 mm, preferably approximately 1.8 mm.

The outer diameter of the projected portion 303C1 is 10 mm–14 mm, preferably approximately 12 mm.

The sealing member 303 includes an engaging hole 303*a* as a driving force transmitting portion for transmitting the driving force received from the main assembly 100 to the feeding member 302 by engagement with one end portion 302*a* of the feeding member 302. The engaging hole 303*a* is formed as an opening (hole) through the sealing portion 303*b* and the coupling engaging portion 303*c*. Here, the engaging hole 303*a* has a rectangular portion corresponding to the rectangular configuration of the end 302*a* of the shaft of the feeding member 302 projected from the powder toner supply portion 301*a*. It has a dimension slightly larger than that of the end 302*a* of the shaft, so that end 302*a* is loosely fitted in the engaging hole 303*a*.

The feeding member 302 and the sealing member 303 are locked with each other in the rotational direction by the loose fitting between the end 302*a* and the engaging hole 303*a*. On the other hand, in the axial direction, relative motion therebetween is permitted. By doing so, the sealing member 303 and the main body 301A of the container are separable from each other so that toner supply port 301*g* is openable upon the toner supply container mounting.

The engagement length between the engaging hole 303*a* and the shaft end 302*a*, is long enough to prevent disengagement therebetween when the sealing member 303 and main body 301A of the container are moved away from each other. Therefore, even if the sealing member 303 is moved away from the main body 301A, the feeding member 302 can receive the driving force through the sealing member 303 (coupling engaging portion 303*c*).

Between the coupling engaging portion 303*c* and the sealing portion 303*b*, a flange portion 3*f* is provided which abuts the end of the powder toner supply portion 301*a* when the sealing portion 303*b* is press-fitted into the toner supply port portion 301*a*. The outer diameter of the flange portion is substantially equal to the outer diameter of the toner supply port portion 301*a* (preferably, it is smaller than the outer diameter of the toner supply port 301*a*). By the flange portion 303*f*, the sealing portion 303*b* enters the toner supply port portion 301*a* by the length of the sealing portion 303*b*.

On the other hand, designated by 303*e* is a locking projection 303*e*, formed at a free end of the coupling engaging portion 303*c*, for locking engagement with the locking member 6 provided in the main assembly 100 of the apparatus. By locking the locking member 6 with the locking projection 303*e*, the sealing member 303 can be fixed when the toner supply port 301*g* is opened.

The sealing member 303 is preferably manufactured by integral injection molding of plastic resin material or like resin material, but another material, manufacturing method and/or non-integral structure are also usable. The sealing member 303 is required to have proper elasticity to effect press-fitting into the toner supply portion 301*a* to seal it. The preferable material is polypropylene, Nylon, high density polyethylene or the like, but a further preferable material is low density polyethylene.

Designated by 303*j* is a locking groove for receiving a locking member 6 provided in the main assembly 100 of the apparatus. The width of the locking groove 303*j* is 1.5 mm–5 mm, preferably approximately 3 mm. The depth of the locking groove is 0.5 mm–5 mm, preferably approximately 2.5 mm.

As described in the foregoing, the sealing member 303 has a substantially cylindrical engaging portion 303*b*1 engageable with the toner supply port portion 303*a*. The flange portion 303*f* is substantially coaxial with the engaging portion 303*b*1. It further includes a projected portion 303*c*1 projected from the flange portion 303*f* substantially coaxially with the engaging portion 303*b*1 at a side opposite from the side where the engaging portion 303*b*1 is provided. Adjacent the free end portion of the projected portion 303*c*1 it is provided with a locking groove 303*c*, and a free end portion is formed into a locking portion 303*e*. There is provided a hollow portion extending from the engaging portion 303*b*1 side to the locking portion 303*e* side, and in the hollow portion, a driving force transmitting portion 303*a* is provided. The locking portion 303*e* of the hollow portion does not open, and therefore, when the engaging portion 303*b*1 is engaged with the toner supply port portion 303*a*, the toner does not leak from the hollow portion to the outside. Thus, the toner supply port portion 303*a* is sealed by mounting the sealing member 303.

Similarly to Embodiment 1 and 2, the sealing member 303 has four functions. More particularly, the sealing member functions are (1) to seal the toner supply port portions 301*a*, (2) to receive the transmission of the rotation force from the main assembly 100 of the apparatus, (3) to transmit the rotation force to the feeding member 303 and (4) to engage with the engageable member 6 provided in the main assembly of the apparatus. Thus, the sealing member 303 transmits the driving force received from the main assembly 100 of the apparatus to the shaft portion 302A through the extending portion 302C to rotate the feeding member 302.

Figure 21:
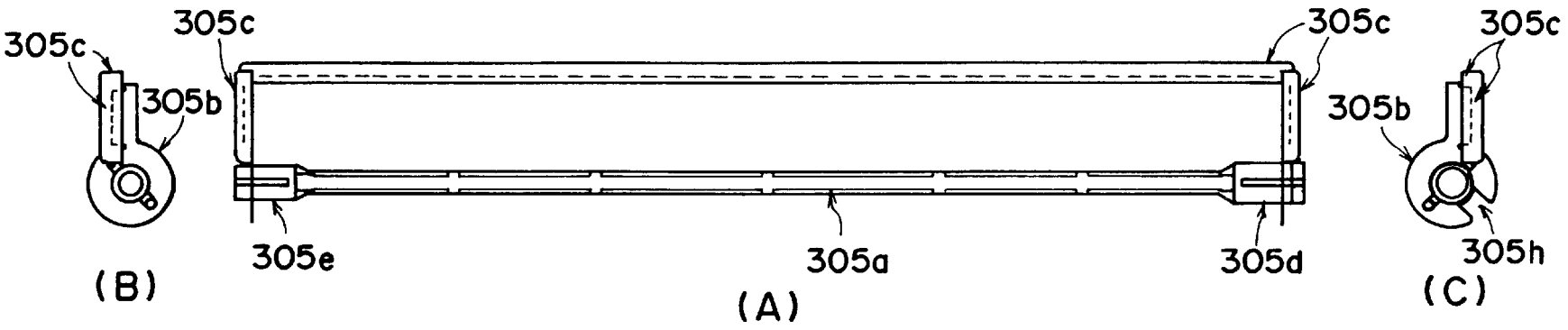
FIG. 21 shows a stirring member, wherein (A) is a front view thereof, (B) is a left side view thereof, and (C) is a right side view thereof.
Figure 23:
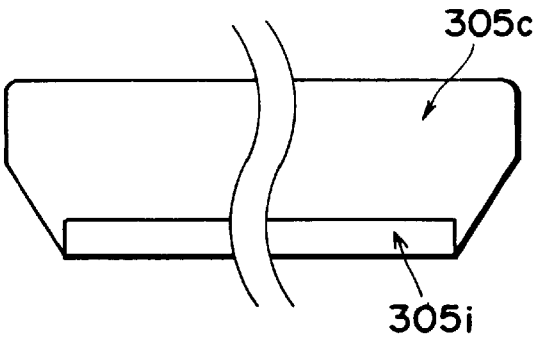
FIG. 23 is an enlarged view of a flexible blade portion.
Figure 22:
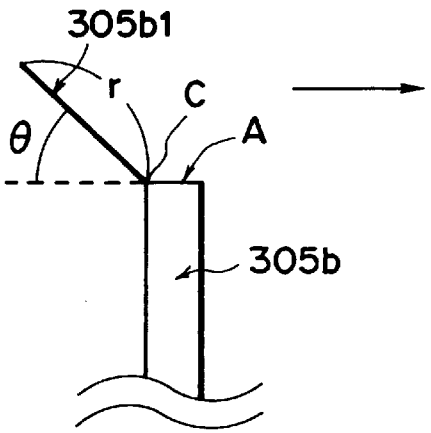
FIG. 22 is an enlarged side view of a rigid blade portion.

A description will be provided as to the stirring member 305. Referring to FIG. 21, (A) is a front view of the stirring member 305, (B) is a left side view, and (C) is a right side view. As shown in FIG. 21, the stirring member 305 includes a shaft portion 305*a*, a rigid blade portion 305*b* and a flexible blade portion 305*c*. FIG. 22 is an enlarged side view of the rigid blade portion 305, and FIG. 23 is an enlarged view of the flexible blade portion 305*c*. The shaft portion 305*a* is made of a relatively high rigid plastic resin material and is manufactured by injection molding. The rigid blade portion 305*b* is made of metal, such as stainless steel or a highly rigid material, and the flexible blade portion 305*c* is made of low rigidity material, such as plastic resin material film or sheet or elastomer sheet. In this embodiment, it is made of a polyester sheet.

One end 305*d* of the stirring member 305 is engaged with the above-described transmitting member 306 at the bearing portion 301*h* of the main body of the toner supply container. The other end 305*e* is engaged with a stopper member (second bearing member) 310*f* at the second receiving portion 301*b*2 of the main body of the toner supply container. The shaft portion 305*a* in this embodiment is made of relatively high rigidity plastic resin material and is manufactured through injection molding, but may be of another material, such as metal.

The rigid blade portion 305*b* is preferably integrally molded using metal or the like, but another material and/or manufacturing method are also usable, or it may be divided into two or more parts, which are unified by welding or bonding or the like. In this embodiment, a pressed stainless steel plate having a thickness of approximately 0.8 mm is used. The engaging portion of the rigid blade portion 305*b*, which are engageable with the shaft portion 305*a*, has a configuration conforming with the shaft portion 305*a* to receive the driving force from the shaft portion 305*a*, and it rotates with the rotational motion of the shaft portion 305*a* to stir the toner in the container.

It is preferable to provide a cut-away portion 305*h* at one end as shown in FIG. 21 since then the assembling is easy. The entire length of the rigid blade portion 305*b* is in the form of a substantially parallel plate relative to the tangential direction of rotation, and the downstream of the blade portion with respect to the rotational direction is bent toward the internal wall surface of the toner supply container. The length r of the bent portion 305*b*1 shown in FIG. 22 is approximately 2 mm–8 mm, and the bending angle 6 is preferably approximately 30°–50°. Further preferably, the length r of the bent portion 305*b* is approximately 3 mm–5 mm, and the bent angle is preferably approximately 45°.

In this embodiment, the length of the bent portion 305*b*1 is approximately 5 mm, and the bending angle is approximately 45°. The distance from the center of the rotation shaft to the free end of the rigid blade portion is properly determined depending on the size of the main body of the container, and it is preferably approximately 70–95% of the inner radius of the main body of the container. In this embodiment, the inner diameter of the main body of the container is approximately 44.5 mm, and therefore, it is approximately 39.4 mm (89%).

The flexible blade portion 305*c* is made of low rigidity material, such as plastic resin material film or sheet or elastomer sheet. The thickness thereof is preferably approximately 50 μm–500 μm and further preferably 100 μm–300 μm. In this embodiment, the use was made with polyester sheet having a thickness of approximately 100 microns.

The flexible blade portion 305*c* is bonded such that its free end contacts the internal wall surface of the main body over the entire length of the bent portion 305*b*1 of the rigid blade portion 305*b*. It rotates, scraping the toner off the internal wall surface of the container with the rigid blade portion. The length, in the radial direction, of the flexible blade portion 305*c* is preferably longer by approximately 0.5 mm–10 mm than the distance between the internal wall surface of the container and the free end of the rigid blade portion 305*b* since then the above-described effect can be enhanced.

In this embodiment, it is longer by approximately 6 mm. The bonding between the rigid blade portion 305*b* and the flexible blade portion 305*c* is made by a double coated tape 305*i* (DIC#8800CH) as shown in FIG. 23 on the bent portion 305*b* of the rigid blade portion 305*b*. Another method using rivets or another known means is usable or the integral molding with the rigid blade portion is usable.

Figure 24:
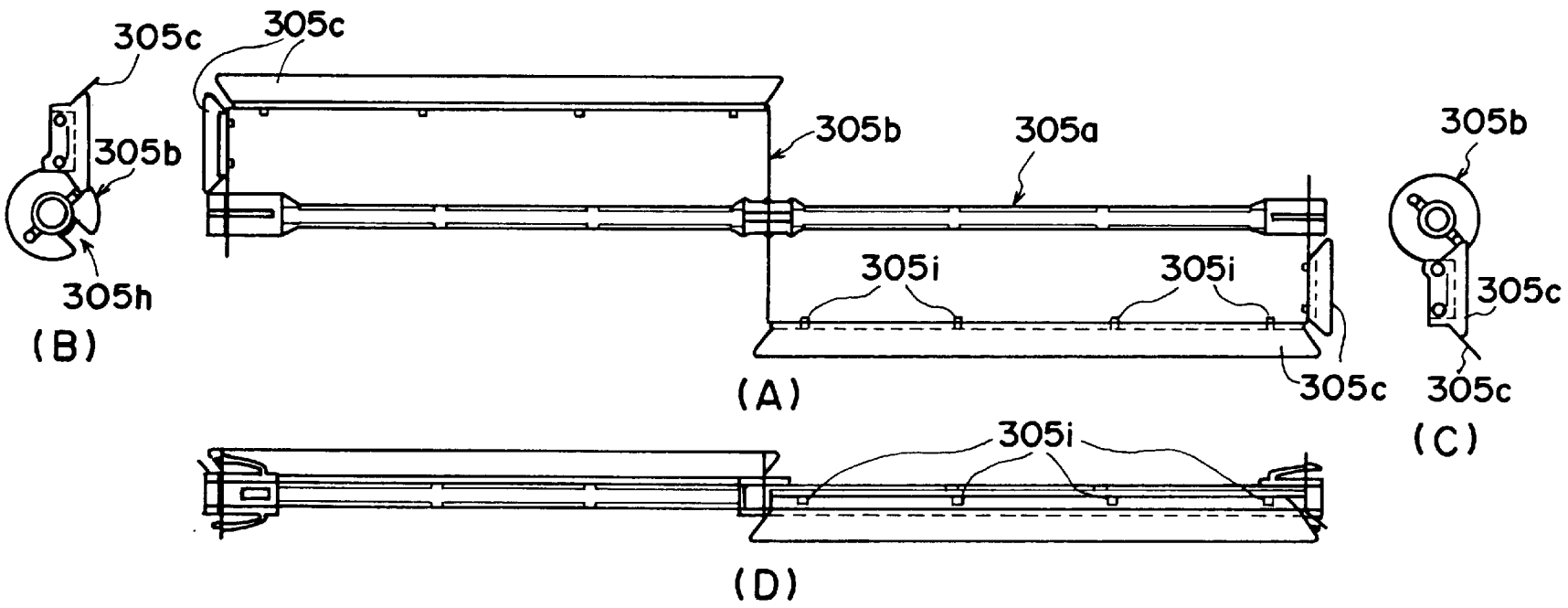
FIG. 24 shows a stirring member according to another embodiment of the present invention, wherein (A) is a front view thereof, (B) is a left side view thereof, (C) is a right side view thereof, and (D) is a bottom view thereof.

As shown in the FIG. 24, the rigid blade portion 305*b* may be divided with a phase difference of 180° substantially at the central portion relative to the axis direction, so that divided parts are staggered. The number of division is properly determined depending on the configuration and length of the main body of the container, and it may be 3 or 4 or more. The phase of the rigid blade portion 305*b* may be changed over the entire length to provide a spiral-like configuration. The engaging portion between the central portion of the shaft portion and the opposite ends of the rigid blade portion 305*b* are preferably provided with a cutaway portion 305*h* as shown in the figure since then the assembling property is improved. The length of the bent portion of the rigid blade is approximately 3 mm to reduce the resistance of the toner and to decrease the projected area of the rigid blade portion in the rotational direction. The length and the bending angle of the bent portion is preferably degree 2–8 mm and 30–50°, and further preferably approximately 3–5 mm and approximately 45°.

The rigid blade portion 305*b* and the flexible blade portion 305*c* may be crimped by means of aluminum rivets 4*i*. In this case, if the position of the rivet hole of the flexible blade portion 305*c* is deviated even slightly, waving may result, and therefore, it is preferable to provide a perforation or half cutting at a portion of the flexible blade portion 305*c* contacting the bent portion C of the rigid blade portion 305*b*. The bonding means may be a double coated tape or another known means.

A description will be provided as to assembling method of the toner supply container 301.

In the assembling method of the toner supply container 301, the feeding member 302 is inserted into the lower portion of the lower frame 301K from the top. An oil seal 309 is inserted into the first receiving portion 301*b*1, and thereafter, a bearing member 308 is engaged with the other end portion 302*b* of the feeding member 302. The toner supply port 301*g* is sealed by the sealing member 303. Then, the stirring member 305 is inserted from the top. An oil seal 309 is inserted into the main body of the container, and thereafter, the second bearing member 310 and the transmitting member 306 are engaged at the opposite ends of the stirring member 305. Then, the upper frame 301J is welded to the lower frame 301K by vibration welding, and a predetermined amount of the toner is supplied into the main body 301A of the container through the filling port 301*i* of the main body of the toner supply container 301, and the filling port 301*i* is sealed by the sealing member 311, so that assembly is completed. In this manner, the assembling of the toner supply container 301 is very easy, and the number of steps of the assembling is very small.

The filling of the toner may be effected through the toner supply port 301*g*.

In this embodiment, the exchange steps of the toner supply container 301 are the same as with the first embodiment and the second embodiment.

When the toner supply port portion 301*a* is opened by the toner supplying portion opening and closing means, the main body 301A of the container receives forces at the toner supply port portion 301*a* and the engaging portion 301*c*. At this time, as described hereinbefore, the engaging portion 301*c* is disposed at a side opposite from the side having a toner supply port portion 301*a* in the longitudinal direction at the lower surface of the main body 301A of the container, and the main body 301A is prevented from rising relative to the main assembly 100. Even if the main body 301A is raised, the motion of the main body 301A beyond a predetermined distance is limited by contact of the upper surface 301E to the top surface portion 100*d* (FIG. 25) of the main assembly 100 of the apparatus.

The engaging projection 301*c* and the toner supply port 301*g* of the toner supply container 301 are preferably disposed on a line in the sliding direction of the container. By doing so, production of a moment in either direction in FIG. 25, relative to the slide direction in the toner supply container 301, can be prevented. Even if a moment in either direction is produced, the movement of the main body 301A beyond a predetermined distance can be prevented by abutment of the rib 301*j*, as a lateral stopper portion, provided in the other side surface 301B to the side wall portion 100*e* provided in the main assembly 100.

The height of the engaging projection 301*c* of the toner supply container 301 is such that overlapping x between the engaging projection 301*c* and the container chucking member 51 (FIG. 25) is larger than the clearance Y between the upper portion 301E of the container and the top surface 100*d*of the main assembly of the apparatus (FIG. 25) in order to prevent the upward disengagement of the toner supply container 301 during the slide movement.

Figure 25:
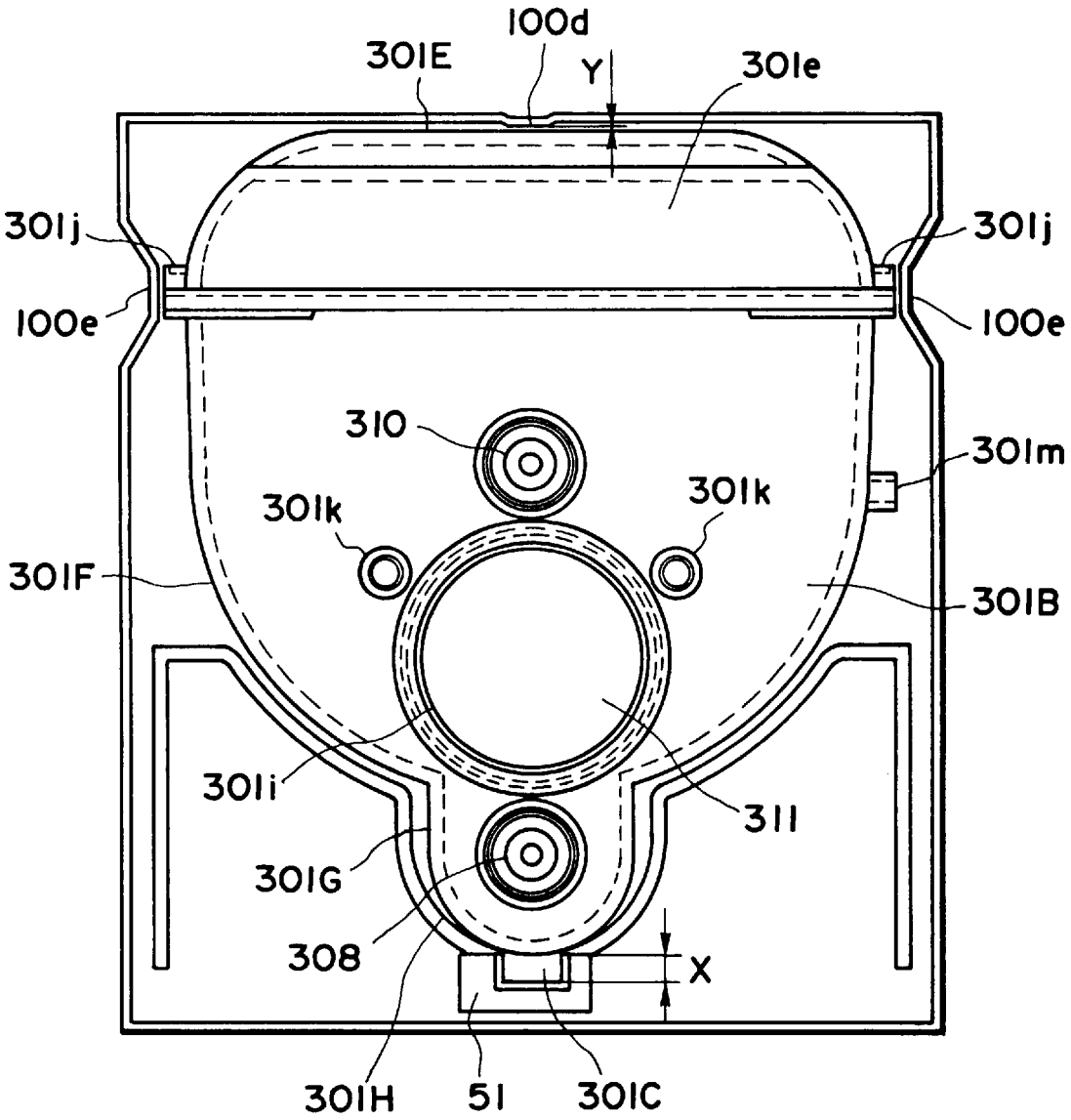
FIG. 25 shows a toner supply container which is mounted in the main assembly of the apparatus.

The horizontal ribs 301*j* of the toner supply container 301 in FIG. 25 are preferably provided on the top part of the toner supply container 301 to prevent the clogging, and in this embodiment, they are disposed at an upper portion (higher than the height center) of the toner supply container 1 with a proper clearance from the side wall portion 100*e*.

A description will be provided as to a driving mechanism for the toner supply container 301 in this embodiment.

When the toner supply container 301 is to be mounted, the coupling engaging portion 303*c* of the sealing member 303 is brought into engagement with the first coupling member 304 of the main assembly 100 of the apparatus as shown in FIG. 16. The first coupling member 304 functions to transmit the driving force of a driving device (unshown) provided in the main assembly 100 to the sealing member 303.

Figure 26:
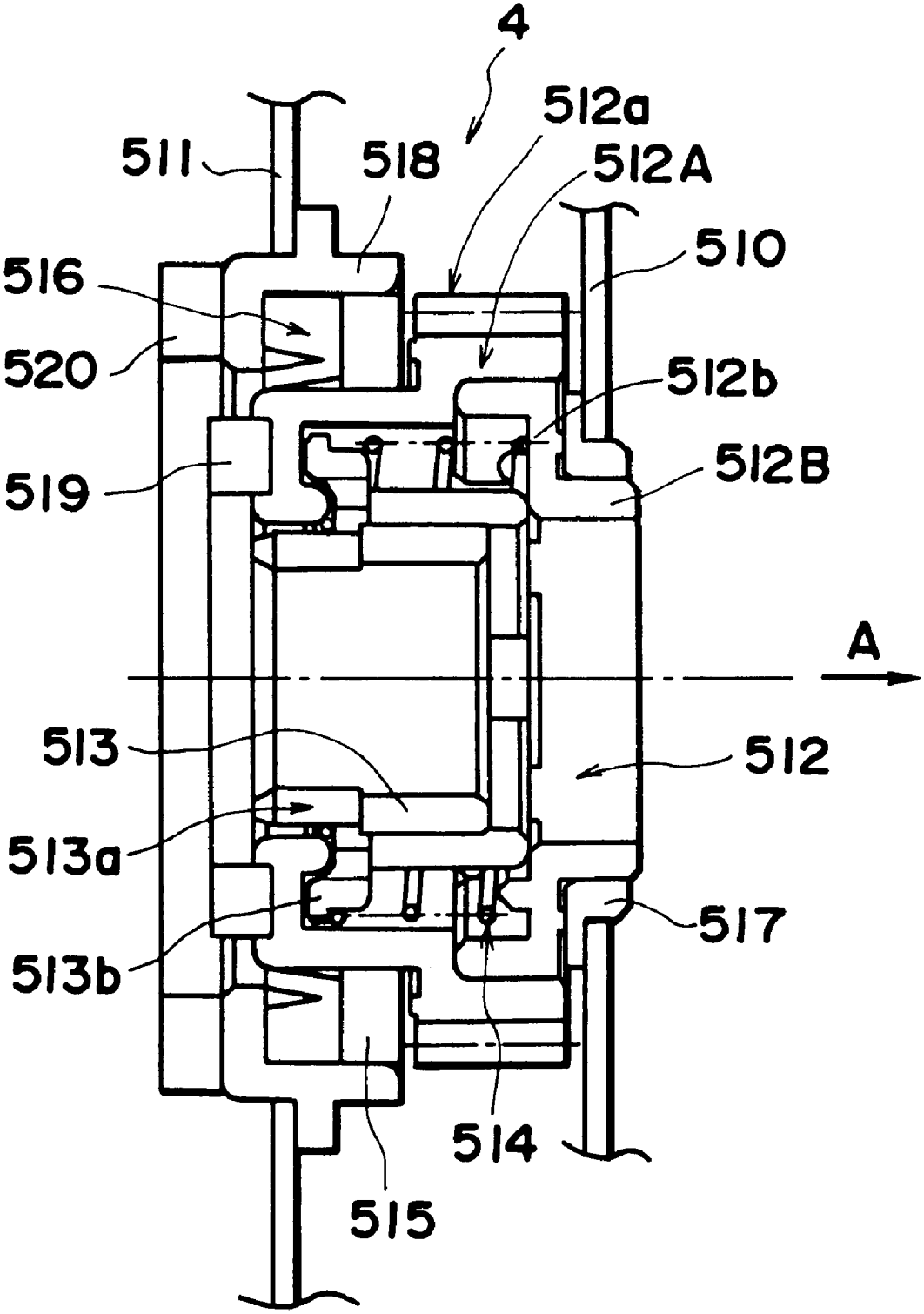
FIG. 26 is a detailed illustration of a second coupling member.

FIG. 26 shows details of the first coupling member 304.

Designated by 512 is a gear member having a gear portion at the outer surface 512. The gear member 512 is constituted by two members, namely, gear portion 512A and cap portion 512B, which are securedly fixed by snap fitting, bonding or the like. The inside of the bear member 512 is provided with urging means 514 and a movable member 513. The urging means 514 abuts the 512*b* portion of the gear member 512 and the 513*b* portion of the movable member 513.

Figure 27:
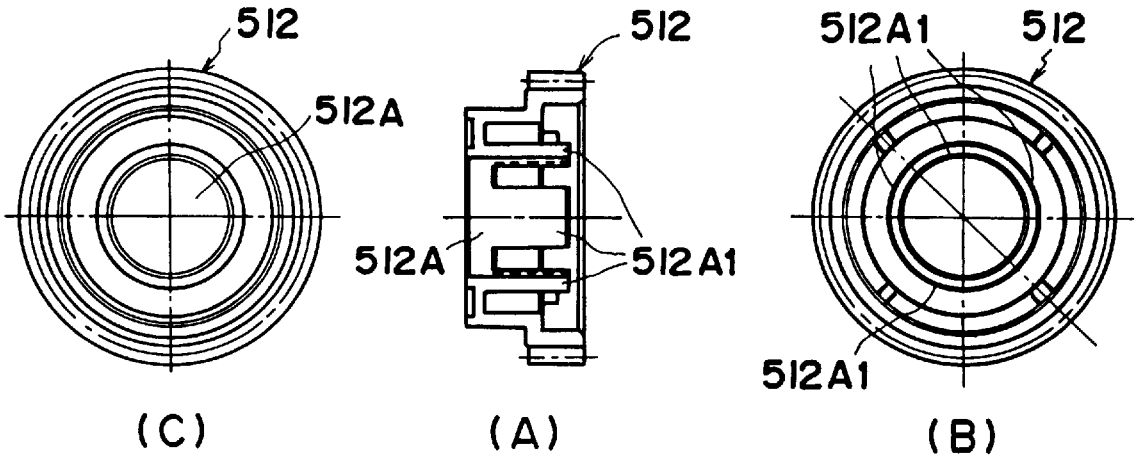
FIG. 27 is a detailed illustration of a gear portion.
Figure 28:
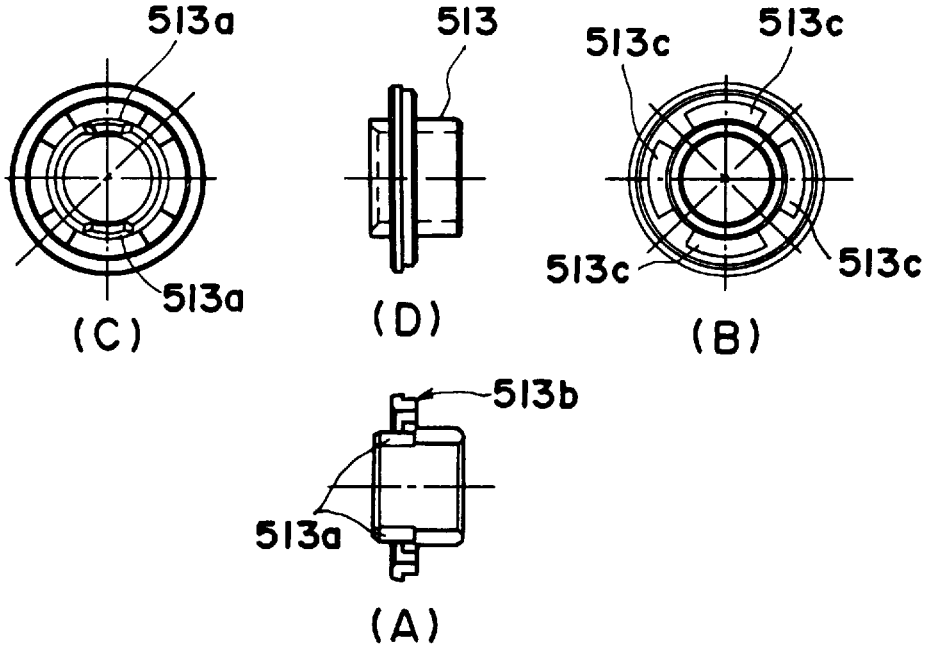
FIG. 28 is a detailed illustration of a movable member.

FIG. 27 is a detailed illustration of the gear portion 512, wherein (A) is a sectional front view, and (B) and (C) are side views. FIG. 28 is a detailed illustration of the movable member 513, wherein (A) is a sectional front view, and (B) and (C) are side views, and (D) is front view.

In FIG. 27, gear portion 512A is provided with four slide guiding ribs 512A1 arranged circumferentially. In FIG. 28, the movable member 513 has four slide guiding hole portions 513*c* circumferentially arranged, and they are engaged with the slide guiding ribs 512A1 of the gear portion 512A, by which the movable member 513 is slidable in the gear member 512.

Designated by 513*a* is a drive transmitting portion of the movable member 513. The drive transmitting portion 513*a* is engaged with an elongated projection 303*d* of the sealing member 303 to transmit the rotation force to the sealing member when the toner supply container 1 is mounted to the main assembly 100 of the apparatus.

In FIG. 27, designated by 517, 515 are bearing members for rotatably supporting the gear member 512, and 516 is an oil seal. The toner discharged through the toner supply port 301*g* is prevented, by the oil seal 516, from entering the bearing members 515, 517 resulting in the locking of the gear member 512. Designated by 519 is a gear seal member, and when the toner supply container 301 is mounted to the main assembly 100 of the apparatus, it is press-contacted to the 303*h* portion (FIG. 20) of the sealing member 303 to prevent the toner discharged through the toner supply port 301*g* from entering the gear member 512. Designated by 511, 510 are driving side plates for supporting the first coupling member 304. Designated by 518 is a bearing holder, which functions to support the bearing 515 and the oil seal 516 and which is securedly fixed on the driving side plate 511 by screws or by bonding. Designated by 520 is a holder seal member, which prevents the toner from leaking between the bearing holding 518 and the holder 5 as shown in FIG. 20.

The gear seal member 519 and the holder seal member 518 are fixed to the gear member 512 and the bearing holder 518, respectively, by double coated tape or the like, and the material thereof is elastic material such as urethane foam.

A description will be provided as to an operation of the first coupling member 304. The movable member 513 of the coupling member is retractable in a direction A in FIG. 26 because of the structure described in the foregoing. Normally, it is urged to a position shown in FIG. 26 by urging means 514. When the toner supply container 301 is mounted to the main assembly 100 of the apparatus, the sealing member 303 enters the coupling member as shown in FIG. 20. If the phases of the projections 303*d* of the sealing member 303 and those of the drive transmitting portions 513*a* of the movable member are matched, the gear member 512 and the movable member 513 are rotated by are unshown main assembly driving mechanism, so that sealing member 303 is rotated through the drive transmitting portion 513*a*. When the phases are not matched, the movable member 513 is urged in the direction A in FIG. 26 by the projection 303*d* of the sealing member 3. When the gear member 512 and the movable member 513 are rotated by the main assembly driver with this state, the movable member 513 rotates idle until the phase matching is reached between the projection 303*d* of the sealing member 303 and the drive transmitting portion 513*a* of the movable member 513. When the phases are matched, the movable member 513 is slid by the urging means 514 to the position shown in FIG. 26 where the drive transmitting portion 513*a* and the elongated projection 303*d* of the sealing member 303 are engaged to transmit the driving to the sealing member 303.

Figure 29:
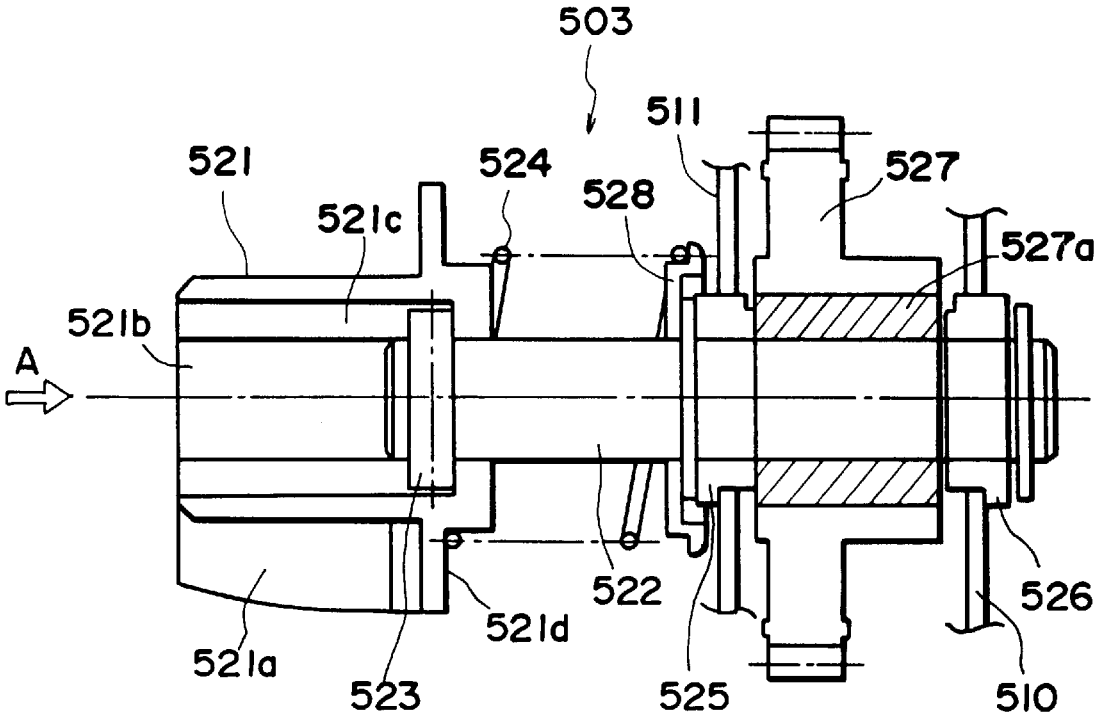
FIG. 29 shows detailed structure of the second coupling member.
Figure 30:
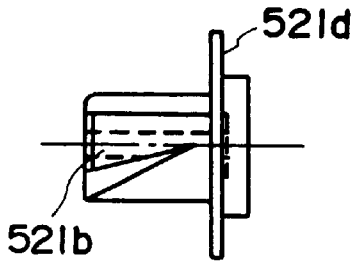
FIG. 30 shows a drive transmission claw, wherein (A) is a sectional front view thereof, (B) is a side view thereof, (C) is a front view thereof, and (D) is a top plan view thereof.
Figure 30:
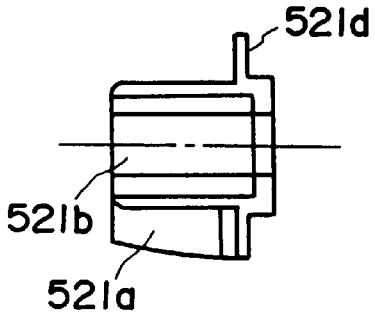
Figure 30:
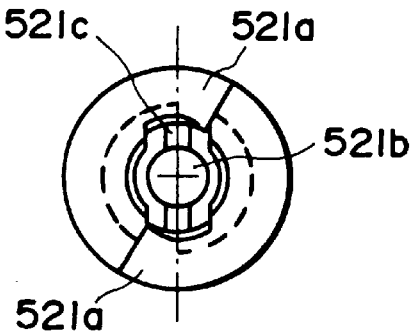
Figure 30:
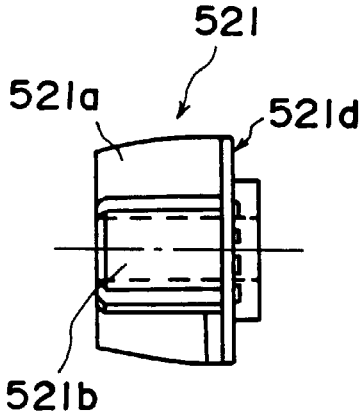
Figure 31:
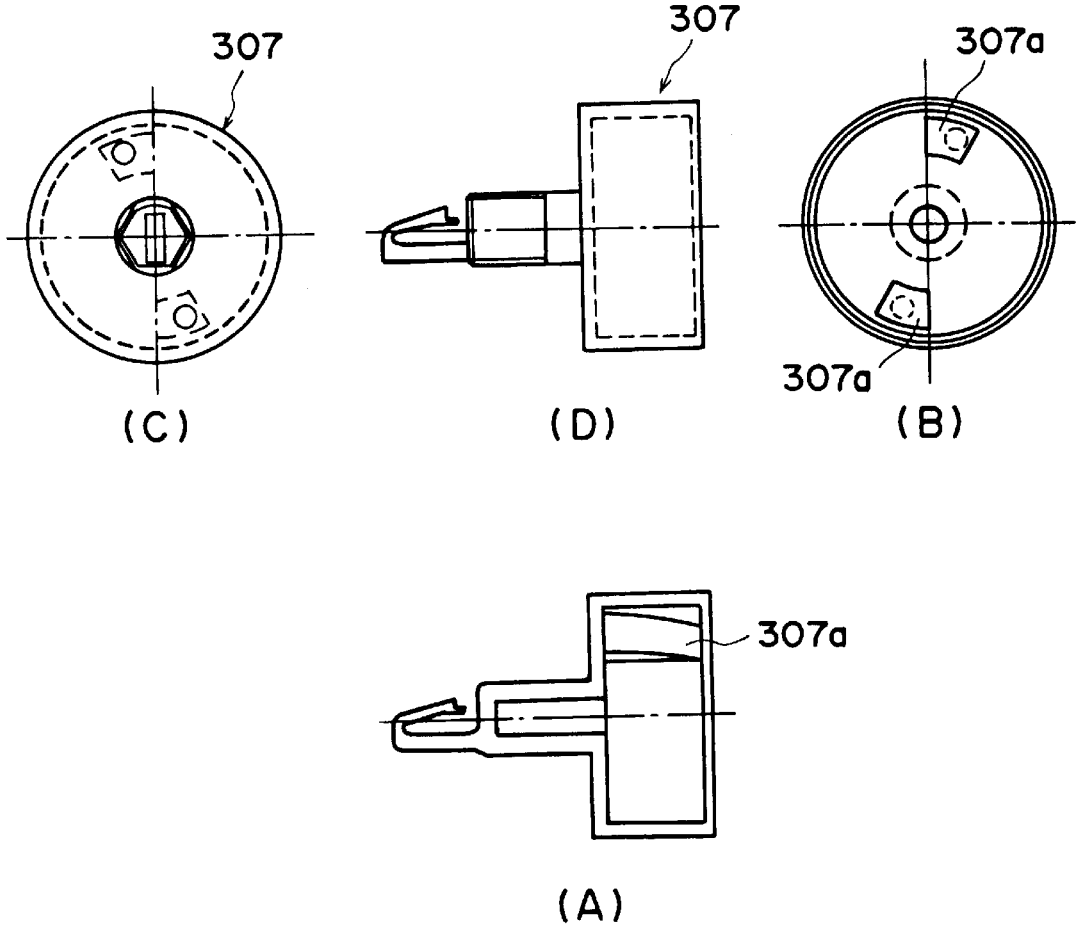
FIG. 31 shows a transmitting member, wherein (A) is a sectional front view thereof, (B) and (C) are side views thereof, and (D) is a front view thereof.

FIG. 29 shows the details of the second coupling member 307. Designated by 521 is a drive transmission claw. In FIG. 30, (A) is a sectional front view of the drive transmission claw 521, (B) is a side view, (C) is a front view, and (D) is an upper surface Figure. In FIG. 30, designated by 521*a* is a claw portion, 521*b* is a slide guiding portion, 521*c* is a parallel pin groove portion, and 521*d* is a spring receiving surface. FIG. 31 is a detailed illustration of the transmitting member 306 shown in FIG. 19, wherein (A) is a sectional front view, (B) and (C) are side view, and (D) is a front view. In FIG. 31, designated by 307*a* is a transmission claw portion.

In FIG. 29, designated by 522 is a driving shaft which is rotatably supported on driving side plates 510 and 511 through bearings 525, 526, and is provided with a one-way gear 527 which is provided with an integral one way 527*a* which transmits rotation only in one rotational direction.

The driving transmission pawl or claw 521 is slidable by engagement between the slide guiding portion 521*b* and the driving shaft 522, and by engagement with the parallel pin groove portion, the rotation of the driving shaft 522 is transmitted to the drive transmission claw 521. Designated by 524 is urging means which is contacted to the spring seat 528 and the spring receiving surface 521*d* of the drive transmission claw 521.

A description will be provided as to an operation of the second coupling member 307. The drive transmission claw 521 of the second coupling member 307 is movable in the direction A in FIG. 32 because of the structure described in the foregoing, and is normally urged to a position shown in FIG. 29 by the urging means 524. When the toner supply container 301 is mounted to the main assembly 100 of the apparatus, the transmitting member 306 enters the second coupling member 307. When the phase relation is such that transmission claw portions 307*a* of the transmitting member 307 are abutted to the claw portions 521*a* of the drive transmission claw 521, the claw portions 521*a* of the drive transmission claw 521 are rotated by the transmission claw portions 307*a* of the reaching member 307. At this time, the driving shaft 522 rotates with the rotation of the transmission member 306, but it rotates idle due to the one way clutch 527*a* portion of the one way gear 527, and therefore, when the toner supply container 301 is mounted to the main assembly 100 of the apparatus, the drive transmission claw 521 and the transmitting member 306 are not interfered with.

In the toner supply container in the state shown in FIG. 16 to which it is moved from the position shown in FIG. 17, the drive transmission claw 521 is moved by the urging means 524 with the retraction of transmitting member 306 to the left, so that engagement between the transmission claw portion 306*a* of the transmitting member 306 and the claw portion 521*a* of the drive transmission claw 521 is maintained.

Thus, the transmitting member 306 receives the rotational driving force through the one way gear 527, driving shaft 522 and the drive transmission claw 521 from the unshown main assembly driving means, so that stirring member 305 is rotated.

A description will be provided as to discharging of the toner.

When the toner supply container 301 is mounted to the main assembly 100 of the apparatus, the locking portion 303*e* at the end of the sealing member 303 is locked with the locking member 51C of the image forming apparatus, and is supported at a position away from the toner supply port 301*g* of the main body 301A of the container. At this time, the engaging relation, in the rotational direction, between the feeding member 302 and the sealing member 303, is maintained.

The sealing member 30 is engaged with a first coupling member 304 of the main assembly of the apparatus by the coupling engaging portion (driving force receiving portion) 303C. The first coupling member 304 receives the rotation through the drive transmitting means (unshown) such as a gear or the like from the driving source (unshown) such as a motor or the like of the main assembly of the apparatus, and is transmitted to the sealing member 303 through engagement with the spline-like projections 303*d*. It is further transmitted to the feeding member 302 through engagement with the free end 302*a* of the feeding member 302 to the non-circular or square hole 303*a*. Similarly, the transmitting member 306 engaged with the one end 304*d* of the stirring member 304 is engaged with a second coupling member 307 of the main assembly of the apparatus. The second coupling member 307 of the main assembly of the apparatus receives the rotation force through the (unshown) drive transmitting means such as a gear from the driving source (unshown) such as a motor of the main assembly of the apparatus, and is transmitted to the stirring member 304 through the engagement with the engaging claw 306*a*. The rotational frequencies of the feeding member 302 and the stirring member 304 are approximately 52 rotations/min and approximately 10 rotations/min in this embodiment.

When the stirring member 304 rotates, the toner which has been caked by removal of air due to long term non-use or due to vibration during transportations, is loosened, and is fed toward the toner supply port portion 301*a* by rotation of the feeding member 302, and is discharged and falls through the toner supply port 1*g* to be supplied to the toner hopper 201*a*.

The discharging experiments were carried out using the containers of the structures. The main body of the container is filled with toner, and the toner was discharged by the stirring member rotated at a speed of approximately 10 rotations/min., and by the feeding member rotated at a speed of approximately 52 rotations/min. The sieve (opening is 75 μm, and made of SUS) was used to check the existence of larger particles, and it was confirmed that no large particles exists. The remainder toner amount in the container is 20 g, and therefore, the reducing effect of the toner remaining amount is also confirmed.

Figure 32:
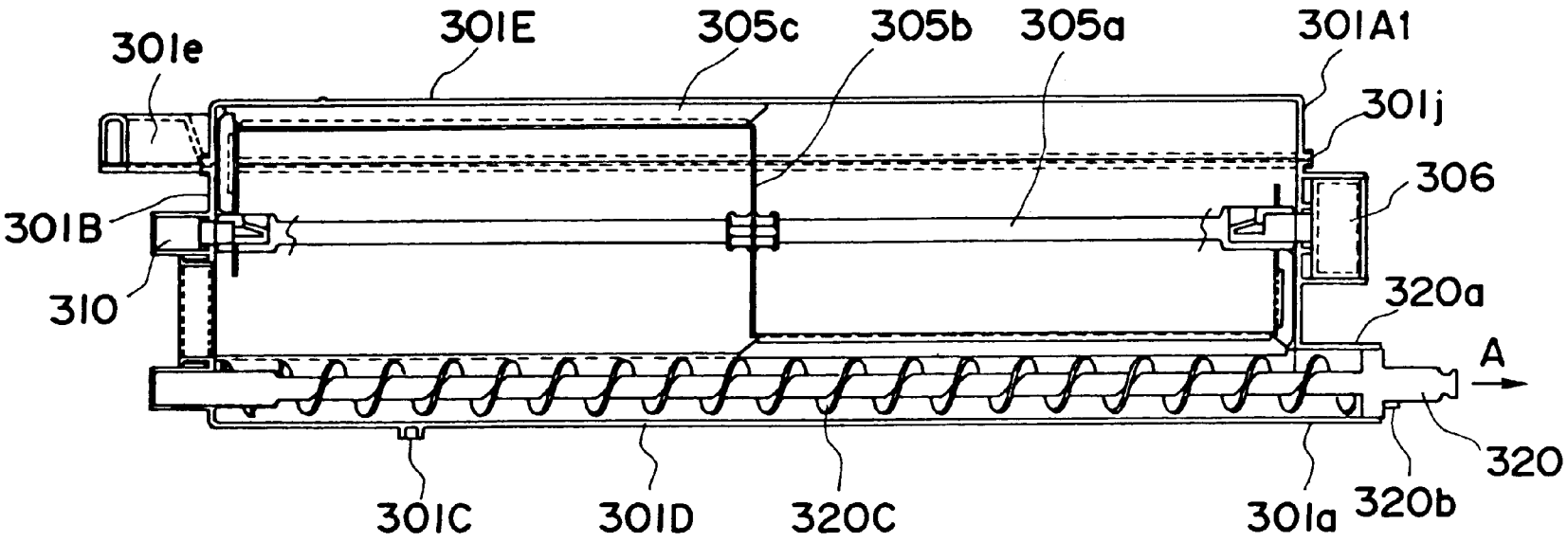
FIG. 32 shows an example wherein the sealing member and the feeding member are integrally formed.

In this embodiment, the sealing member 303 is movable in the axial direction relative to the feeding member 302, but the sealing member and the feeding member may be integral. In FIG. 32, the sealing member 320 includes the sealing portion 320*a*, the driving force receiving portion 320*b* and the sealing member 320. The sealing member 320 is movable in the direction A in FIG. 32.

The toner container of the embodiments is summarized as follows:

A toner supply container detachably mountable to a main assembly of an electrophotographic image forming apparatus, comprising:

(a) a toner accommodating portion (e.g. in, 301*n*) for accommodating toner;

(b) a toner supply opening (e.g. 1*a*, 301*a*) for discharging toner accommodated in the toner accommodating portion;

(c) a toner feeding portion (e.g. 2, 302) for feeding the toner accommodated in the toner accommodating portion toward the toner supply port;

(d) a first driving force receiving portion (e.g. 3*d*, 303*d*) for receiving a driving force for driving the toner feeding portion from the main assembly of the apparatus;

(e) a toner stirring portion (e.g. 4, 305) for stirring the toner accommodated in the toner accommodating portion; and (f) a second driving force receiving portion (e.g. 4*c*, 307*a*) for receiving a driving force for driving the toner stirring portion from the main assembly of the apparatus;

wherein the first driving force receiving portion and the second driving force receiving portion are disposed outside the toner accommodating portion and at a free end portion in a direction of mounting the toner supply container to the main assembly of the apparatus.

The first driving force receiving portion is located so as to be disposed below the second driving force receiving portion when the toner supply container is detachably mounted to the main assembly of the apparatus.

The first driving force receiving portion is disposed downstream of the second driving force receiving portion with respect to the mounting direction.

The first driving force receiving portion and the second driving force receiving portion are rotatable, and a rotation radius of the second driving force receiving portion is larger than that of the first driving force receiving portion.

The first driving force receiving portion and the second driving force receiving portion receive the driving force at a downstream side with respect to a toner feeding direction of the toner feeding portion when the toner supply container is mounted to the main assembly of the apparatus.

The first driving force receiving portion is in the form of a projection extended along an axial direction of the toner feeding portion, and the second driving force receiving portion is in the form of a projection extended along an axial direction of the toner stirring portion, wherein the first driving force receiving portions receives the driving force by engagement with a groove (e.g. 5*c*, 513*c*) provided in the main assembly of said apparatus, and the second driving force receiving portion receives the driving force by engagement with a projection (e.g. 9*b*, 521*a* ) provided in the main assembly of the apparatus when said toner supply container is mounted to the main assembly of the apparatus.

There is provided a grip (301*e*) portion for facilitating mounting of the toner supply container to the main assembly of the apparatus, wherein the grip portion is provided at a side opposite from a side having the first driving force receiving portion and the second driving force receiving portion in a longitudinal direction of the toner supply container.

A distance between a center of rotation of the first driving force receiving portion and a center of rotation of the second driving force receiving portion is 50 mm–60 mm, and a rotation radius of the second driving force receiving portion is 9 mm–15 mm, and a rotation radius of the first driving force receiving Portion is 4 mm–8 mm.

The toner supply container supplies the toner accommodated in the toner accommodating portion into the main assembly of the apparatus through the toner supply port by rotation of the toner feeding portion in accordance with consumption of the toner in the main assembly of the apparatus when said toner supply container is mounted to the main assembly of the apparatus.

The toner stirring portion includes a shaft and a blade having a rigid (305*b*) portion and a flexible portion (305*c*) mounted to the rigid portion.

As described in the foregoing, according to the embodiments of the present invention, there is provided a toner supply container which is kept in the main assembly of an electrophotographic image forming apparatus and which can supply the toner into the main assembly of the apparatus with high reliability.

Additionally, there is provided a toner supply container of a low-manufacturing cost type.

Furthermore, there is provided a toner supply container capable of stirring and feeding the toner with certainty.

Moreover, there is provided an electrophotographic image forming apparatus to which such a toner supply container is detachably mountable.

While the invention has been described with reference to the structures disclosed herein, it is not confined to the details set forth and this application is intended to cover such modifications or changes as may come within the purposes of the improvements of the scope of the following claims.

What is claimed is:

1. A toner supply container detachably mountable to a main assembly of an electrophotographic image forming apparatus, comprising:

(a) a toner accommodating portion for accommodating toner;

(b) a toner supply opening for discharging toner accommodated in said toner accommodating portion;

(c) a toner feeding portion for feeding the toner accommodated in said toner accommodating portion toward said toner supply opening;

(d) a first driving force receiving portion for receiving a driving force for driving said toner feeding portion from the main assembly of said apparatus;

(e) a toner stirring portion for stirring the toner accommodated in said toner accommodating portion;

(f) a second driving force receiving portion for receiving a driving force for driving said toner stirring portion from the main assembly of said apparatus;

wherein said toner supply container is inserted unidirectionally into the main assembly for said first driving force receiving portion and said second driving force receiving portion to engage with corresponding parts in the main assembly, and wherein said first driving force receiving portion and said second driving force receiving portion are disposed outside said toner accommodating portion and at a leading end portion with respect to the unidirectional mounting direction; and (g) a grip, provided at a trailing end portion with respect to the unidirectional mounting direction, to facilitate mounting and demounting of the toner supply container.

2. A toner supply container according to claim 1, wherein said first driving force receiving portion is located so as to be disposed below said second driving force receiving portion when said toner supply container is detachably mounted to the main assembly of said apparatus.

3. A toner supply container according to claim 1, wherein said first driving force receiving portion and said second driving force receiving portion are rotatable, and a rotation radius of said second driving force receiving portion is larger than that of said first driving force receiving portion.

4. A toner supply container according to claim 3, wherein the distance between a center of rotation of said first driving force receiving portion and a center of rotation of said second driving force receiving portion is 50 mm–60 mm, and a rotation radius of said second driving force receiving portion is 9 mm–15 mm, and a rotation radius of said first driving force receiving portion is 4 mm–8 mm.

5. A toner supply container according to claim 1, wherein said first driving force receiving portion and said second driving force receiving portion receive the driving force at a downstream side with respect to a toner feeding direction of said toner feeding portion when said toner supply container is mounted to the main assembly of said apparatus.

6. A toner supply container according to claim 1, wherein said first driving force receiving portion is in the form of a projection extending along an axial direction of said toner feeding portion, and said second driving force receiving portion is in the form of a projection extending along an axial direction of said toner stirring portion, wherein said first driving force receiving portion receives the driving force by engagement with a groove provided in the main assembly of said apparatus, and said second driving force receiving portion receives the driving force by engagement with a projection provided in the main assembly of said apparatus when said toner supply container is mounted to the main assembly of said apparatus.

7. A toner supply container according to claim 1, wherein said toner supply container supplies the toner accommodated in said toner accommodating portion into the main assembly of said apparatus through said toner supply port by rotation of said toner feeding portion in accordance with consumption of the toner in the main assembly of said apparatus when said toner supply container is mounted to the main assembly of said apparatus.

8. A toner supply container according to claim 1, wherein said toner stirring portion includes a shaft and a blade having a rigid portion and a flexible portion mounted to the rigid portion.

9. A toner supply container detachably mountable to a main assembly of an electrophotographic image forming apparatus, comprising:

(a) a toner accommodating portion for accommodating toner;

(b a toner supply opening for discharging toner accommodated in said toner accommodating portion;

(c) a toner feeding portion for feeding the toner accommodated in said toner accommodating portion toward said toner supply opening;

(d) a first driving force receiving portion for receiving a driving force for driving said toner feeding portion from the main assembly of said apparatus;

(e) a toner stirring portion for stirring the toner accommodated in said toner accommodating portion;

(f) a second driving force receiving portion for receiving a driving force for driving said toner stirring portion from the main assembly of said apparatus;

wherein said first driving force receiving portion and said second driving force receiving portion are disposed outside said toner accommodating portion and at a free end portion in a direction of mounting said toner supply container to the main assembly of said apparatus, wherein said first driving force receiving portion is disposed downstream of said second driving force receiving portion with respect to the mounting direction.

10. A toner supply container detachably mountable to a main assembly of an electrophotographic image forming apparatus, comprising:

(a) a toner accommodating portion for accommodating toner;

(b) a toner supply opening for discharging toner accommodated in said toner accommodating portion;

(c) a toner feeding portion for feeding the toner accommodated in said toner accommodating portion toward said toner supply opening;

(d) a rotatable first driving force receiving portion for receiving a driving force for driving said toner feeding portion from the main assembly of said apparatus;

(e) a toner stirring portion for stirring the toner accommodated in said toner accommodating portion; and (f) a rotatable second driving force receiving portion for receiving a driving force for driving said toner stirring portion from the main assembly of said apparatus, wherein said second driving force receiving portion is located so as to be disposed above said first driving force receiving portion when said toner supply container is mounted to the main assembly of said apparatus, and wherein said second driving force receiving portion is disposed upstream of said first driving force receiving portion in a direction of mounting said toner supply container to the main assembly of said apparatus, and wherein a rotation radius of said second driving force receiving portion is larger than that of said first driving force receiving portion;

wherein said first driving force receiving portion and said second driving force receiving portion are disposed outside said toner accommodating portion and at a free end portion in a direction of mounting said toner supply container to the main assembly of said apparatus, and wherein said first driving force receiving portion and said second driving force receiving portion receive the driving force at a downstream side with respect to a toner feeding direction of said toner feeding portion when said toner supply container is mounted to the main assembly of said apparatus.

11. A toner supply container according to claim 10, wherein said first driving force receiving portion is in the form of a projection extending along an axial direction of said toner feeding portion, and said second driving force receiving portion is in the form of a projection extending along an axial direction of said toner stirring portion, wherein said first driving force receiving portion receives the driving force by engagement with a groove provided in the main assembly of said apparatus, and said second driving force receiving portion receives the driving force by engagement with a projection provided in the main assembly of said apparatus when said toner supply container is mounted to the main assembly of said apparatus.

12. A toner supply container according to claim 10, further comprising a grip portion for facilitating mounting of said toner supply container to the main assembly of said apparatus, wherein said grip portion is provided at a side opposite from a side having said first driving force receiving portion and said second driving force receiving portion in a longitudinal direction of said toner supply container.

13. A toner supply container according to claim 10, wherein the distance between a center of rotation of said first driving force receiving portion and a center of rotation of said second driving force receiving portion is 50 mm–60 mm, and a rotation radius of said second driving force receiving portion is 9 mm–15 mm, and a rotation radius of said first driving force receiving portion is 4 mm–8 mm.

14. A toner supply container according to claim 10, wherein said toner supply container supplies the toner accommodated in said toner accommodating portion into the main assembly of said apparatus through said toner supply port by rotation of said toner feeding portion in accordance with consumption of the toner in the main assembly of said apparatus when said toner supply container is mounted to the main assembly of said apparatus.

15. A toner supply container according to claim 10, wherein said toner stirring portion includes a shaft and a blade having a rigid portion and a flexible portion mounted to the rigid portion.

16. A toner supply container detachably mountable to a main assembly of an electrophotographic image forming apparatus, comprising:

(a) a toner accommodating portion for accommodating toner;

(b) a toner supply opening for discharging toner accommodated in said toner accommodating portion;

(c) a toner feeding portion for feeding the toner accommodated in said toner accommodating portion toward said toner supply opening;

(d) a rotatable first driving force receiving portion for receiving a driving force for driving said toner feeding portion from the main assembly of said apparatus, wherein said first driving force receiving portion is in the form of a projection extending along an axial direction of said toner feeding portion, and wherein said first driving force receiving portion receives a driving force by engagement with a groove provided in the main assembly when said toner supply container is mounted to the main assembly of said apparatus;

(e) a toner stirring position for stirring the toner accommodated in said toner accommodating portion;

(f) a rotatable second driving force receiving portion for receiving a driving force for driving said toner stirring portion from the main assembly of said apparatus, wherein said second driving force receiving portion is located so as to be disposed above said first driving force receiving portion when said toner supply container is mounted to the main assembly of said apparatus, and wherein said second driving force receiving portion is disposed upstream of said first driving force receiving portion in a direction of mounting said toner supply container to the main assembly of said apparatus, and wherein a rotation radius of said second driving force receiving portion is larger than that of said first driving force receiving portion, wherein said second driving force receiving portion is in the form of a projection extending along an axial direction of said toner stirring portion, and wherein said second driving force receiving portion receives a driving force by engagement with a projection provided in the main assembly of said apparatus when said toner supply container is mounted to the main assembly of said apparatus;

(g) a grip portion for facilitating mounting of said toner supply container to the main assembly of said apparatus, wherein said grip portion is provided at a side opposite from a side having said first driving force receiving portion and said second driving force receiving portion in a longitudinal direction of said toner supply container;

wherein said first driving force receiving portion and said second driving force receiving portion are disposed outside said toner accommodating portion and at a free end portion in a direction of mounting said toner supply container to the main assembly of said apparatus;

wherein said first driving force receiving portion and said second driving force receiving portion receive the driving force at a downstream side with respect to a toner feeding direction of said toner feeding portion when said toner supply container is mounted to the main assembly of said apparatus, and wherein said toner supply container supplies the toner accommodated in said toner accommodating portion into the main assembly of said apparatus through said toner supply opening by rotation of said toner feeding portion in accordance with consumption of the toner in the main assembly of said apparatus when said toner supply container is mounted to the main assembly of said apparatus.

17. A toner supply container according to claim 16, wherein the distance between a center of rotation of said first driving force receiving portion and a center of rotation of said second driving force receiving portion is 50 mm–60 mm, and a rotation radius of said second driving force receiving portion is 9 mm–15 mm, and a rotation radius of said first driving force receiving portion is 4 mm–8 mm.

18. A toner supply container according to claim 16, wherein said toner stirring portion includes a shaft and a blade having a rigid portion and a flexible portion mounted to the rigid portion.

* * * * *